US009675859B2

(12) United States Patent
Green et al.

(10) Patent No.: US 9,675,859 B2
(45) **Date of Patent: *Jun. 13, 2017**

(54) TRIGGERLESS HANDLE MECHANISM AND SHOCK ABSORBING ELEMENTS FOR BASKETBALL SYSTEM

(71) Applicant: Lifetime Products, Inc., Clearfield, UT (US)

(72) Inventors: Danny Green, Layton, UT (US); S. Curtis Nye, Clinton, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 89 days.

This patent is subject to a terminal disclaimer.

(21) Appl. No.: 14/629,153

(22) Filed: Feb. 23, 2015

(65) Prior Publication Data

US 2015/0165290 A1 Jun. 18, 2015

Related U.S. Application Data

(63) Continuation of application No. 13/533,714, filed on Jun. 26, 2012, now Pat. No. 8,992,350.

(Continued)

(51) Int. Cl.
*A63B 63/08* (2006.01)

(52) U.S. Cl.
CPC ..... *A63B 63/083* (2013.01); *A63B 2063/086* (2013.01); *A63B 2225/093* (2013.01)

(58) Field of Classification Search
CPC ..... A63B 63/08

(Continued)

(56) References Cited

U.S. PATENT DOCUMENTS 13,396 A 8/1855 Perkins
130,449 A 8/1872 Stuart (Continued)

FOREIGN PATENT DOCUMENTS

CN 2528493 Y 1/2003
CN 2640548 9/2004

(Continued)

OTHER PUBLICATIONS

International Search Report and Written Opinion of PCT/US2015/037129 dated Sep. 21, 2015, filed Jun. 23, 2015.

(Continued)

*Primary Examiner* — Gene Kim
*Assistant Examiner* — Jeffrey Vanderveen
(74) *Attorney, Agent, or Firm* — Workman Nydegger

(57) ABSTRACT

In one example, a basketball system a goal attached to a backboard assembly. A connecting structure connects the backboard assembly to a support structure. A height adjustment mechanism includes a handle assembly that is directly connected to the support structure, and the handle assembly is operable to change a height of the goal and backboard assembly. As well, a shock absorbing element is provided that includes a first portion directly connected to the handle assembly, and the shock absorbing element has a second portion directly connected to the support structure of the basketball system, and the shock absorbing element enables temporary displacement of the goal and the backboard in response to imposition of a load or force on the goal. Finally, a structure is provided that is directly connected to the handle assembly and directly connected to the connecting structure.

14 Claims, 13 Drawing Sheets

Related U.S. Application Data

(60) Provisional application No. 61/502,452, filed on Jun. 29, 2011.

(58) Field of Classification Search
USPC ..... 473/454, 481, 484
See application file for complete search history.

(56) References Cited

U.S. PATENT DOCUMENTS

| | | | |
|---|---|---|---|
| 2,321,378 | A | 6/1943 | Green |
| 3,025,058 | A | 3/1962 | Brumfield |
| 3,788,604 | A | 1/1974 | Cameron |
| 4,145,044 | A | 3/1979 | Wilson |
| 4,185,936 | A | 1/1980 | Takahashi |
| 4,285,518 | A | 8/1981 | Pearo |
| 4,375,934 | A | 3/1983 | Elliott |
| 4,424,968 | A | 1/1984 | Smith |
| 4,465,277 | A | 8/1984 | Dittrich |
| 4,723,777 | A | 2/1988 | Jolly |
| 4,762,319 | A | 8/1988 | Krumholz |
| 4,781,375 | A | 11/1988 | Nye |
| 4,805,904 | A | 2/1989 | Nye |
| 4,881,734 | A | 11/1989 | Nye |
| 5,112,023 | A | 5/1992 | Sowers |
| 5,114,141 | A | 5/1992 | Mahoney |
| 5,120,054 | A | 6/1992 | Wetzel |
| 5,133,547 | A | 7/1992 | Pardi |
| 5,154,414 | A | 10/1992 | Auer |
| 5,165,565 | A | 11/1992 | Schlessmann |
| 5,207,407 | A | 5/1993 | Fitzsimmons |
| 5,211,393 | A | 5/1993 | Rolffs |
| 5,248,140 | A | 9/1993 | Mower |
| 5,259,612 | A | 11/1993 | Matherne |
| 5,324,027 | A | 6/1994 | Nye |
| 5,375,835 | A | 12/1994 | Van Nimwegen et al. |
| 5,377,976 | A | 1/1995 | Matherne |
| 5,415,393 | A | 5/1995 | Fitzsimmons |
| 5,489,107 | A | 2/1996 | Kho |
| 5,556,088 | A | 9/1996 | Mower |
| 5,573,237 | A | 11/1996 | Van Nimwegen et al. |
| 5,586,759 | A | 12/1996 | Fitzsimmons |
| 5,695,417 | A | 12/1997 | Winter et al. |
| 5,730,668 | A | 3/1998 | Hege |
| 5,738,601 | A | 4/1998 | Hughes |
| 5,800,295 | A | 9/1998 | Rogitz |
| 5,816,955 | A | 10/1998 | Nordgran |
| 5,839,982 | A | 11/1998 | Hying |
| 5,879,247 | A | 3/1999 | Winter et al. |
| 6,004,231 | A | 12/1999 | Schickert |
| 6,042,297 | A | 3/2000 | Lah |
| 6,077,177 | A | 6/2000 | Winter et al. |
| 6,120,396 | A | 9/2000 | Van Nimwegen et al. |
| 6,135,901 | A | 10/2000 | VanNimwegen |
| 6,142,891 | A | 11/2000 | Winter et al. |
| 6,145,856 | A | 11/2000 | Conti |
| 6,155,938 | A | 12/2000 | Mower |
| 6,273,834 | B1 | 8/2001 | Winter |
| 6,283,878 | B1 | 9/2001 | White |
| 6,302,811 | B1 | 10/2001 | Topham |
| 6,334,822 | B1 | 1/2002 | Zider |
| 6,367,948 | B2 | 4/2002 | Branson |
| 6,402,644 | B2 | 6/2002 | Stanford et al. |
| 6,419,597 | B1 | 7/2002 | VanNimwegen et al. |
| 6,419,598 | B1 | 7/2002 | Winter et al. |
| 6,422,957 | B1 | 7/2002 | Winter et al. |
| 6,432,003 | B1 | 8/2002 | Van Nimwegen et al. |
| 6,468,373 | B1 | 10/2002 | Grinwald |
| 6,488,599 | B2 | 12/2002 | Nye |
| 6,645,095 | B1 | 11/2003 | Nye et al. |
| D484,200 | S | 12/2003 | Bingham |
| 6,656,065 | B2 | 12/2003 | Nye |
| D484,933 | S | 1/2004 | Stanford |
| 6,699,146 | B1 | 3/2004 | Winter et al. |
| 6,758,768 | B2 | 7/2004 | Spencer |
| 6,769,668 | B2 | 8/2004 | Siglock |
| D498,800 | S | 11/2004 | Nye |
| 6,824,481 | B1 | 11/2004 | Nye |
| D503,441 | S | 3/2005 | Stanford |
| 6,866,596 | B2 | 3/2005 | Steed |
| 6,881,162 | B2 | 4/2005 | Nye |
| 6,916,257 | B1 | 7/2005 | Van Nimwegen et al. |
| 6,994,502 | B2 | 2/2006 | Winter |
| 7,001,290 | B2 | 2/2006 | Mower |
| 7,044,867 | B2 | 5/2006 | Van Nimwegen et al. |
| 7,048,655 | B2 | 5/2006 | Nye |
| 7,052,418 | B2 | 5/2006 | Nye |
| 7,097,574 | B2 | 8/2006 | Nye |
| 7,118,500 | B2 | 10/2006 | Nye |
| D532,466 | S | 11/2006 | Nye |
| 7,195,571 | B2 | 3/2007 | Nye |
| 7,393,293 | B2 | 7/2008 | Guerzini |
| 7,604,555 | B2 | 10/2009 | Nye |
| 7,691,014 | B2 | 4/2010 | Nye |
| 7,691,015 | B2 | 4/2010 | Nye |
| 7,775,917 | B2 | 8/2010 | Nye |
| 8,062,152 | B2 | 11/2011 | Nye |
| 8,172,706 | B2 | 5/2012 | Peery |
| 8,348,788 | B2 | 1/2013 | Nye |
| 8,708,844 | B2 * | 4/2014 | Nye ..... A63B 63/083 473/484 |
| 8,992,350 | B2 * | 3/2015 | Green ..... A63B 63/083 473/481 |
| 2001/0024984 | A1 | 9/2001 | Stanford et al. |
| 2002/0094890 | A1 | 7/2002 | White |
| 2006/0116225 | A1 | 6/2006 | Kilpatrick |
| 2007/0191151 | A1 * | 8/2007 | Nye ..... A63B 63/083 473/479 |
| 2008/0039242 | A1 | 2/2008 | Nye |
| 2009/0069130 | A1 | 3/2009 | Nye et al. |
| 2010/0084534 | A1 | 4/2010 | Greenwood |
| 2012/0028740 | A1 * | 2/2012 | Nye ..... A63B 63/083 473/483 |
| 2013/0005514 | A1 * | 1/2013 | Green ..... A63B 63/083 473/484 |
| 2015/0367213 | A1 | 12/2015 | Olsen |

FOREIGN PATENT DOCUMENTS

| | | |
|---|---|---|
| CN | 200880000008 | 12/2010 |
| CN | 200880000008 | 10/2011 |
| EP | 12174326 | 10/2012 |
| EP | 12174326 | 1/2013 |

OTHER PUBLICATIONS

U.S. Appl. No. 13/253,762, filed Jul. 6, 2012, Notice of Allowance.
U.S. Appl. No. 13/253,762, filed Sep. 14, 2012, Notice of Allowance.
U.S. Appl. No. 11/836,121, filed Jun. 13, 2013, Final Office Action.
U.S. Appl. No. 11/625,677, filed Jul. 27, 2010, Advisory Action.
U.S. Appl. No. 11/625,677, filed Apr. 29, 2013, Office Action.
U.S. Appl. No. 11/625,677, filed Nov. 1, 2013, Notice of Allowance.
U.S. Appl. No. 13/533,714, filed Aug. 21, 2014, Office Action.
U.S. Appl. No. 13/403,226, filed Feb. 23, 2012, Astle.
U.S. Appl. No. 11/625,677, filed Jan. 22, 2007, Nye.
U.S. Appl. No. 11/836,121, filed Aug. 8, 2007, Nye.
U.S. Appl. No. 13/253,762, filed Oct. 5, 2011, Nye.
Spalding Equipment—2500 Portable Backstop, Recreational Portables; www.spaldingequipment.com/products; Jun. 25, 2012.
U.S. Appl. No. 13/253,762, filed Jan. 20, 2012, Office Action.
U.S. Appl. No. 13/253,762, filed Jun. 1, 2012, Final Office Action.
U.S. Appl. No. 12/192,046, filed Aug. 4, 2010, Office Action.
U.S. Appl. No. 12/192,046, filed Apr. 4, 2011, Final Office Action.
U.S. Appl. No. 12/192,046, filed Jun. 23, 2011, Advisory Action.
U.S. Appl. No. 12/192,046, filed Jul. 18, 2011, Notice of Allowance.
U.S. Appl. No. 11/836,121, filed Jun. 1, 2009, Office Action.
U.S. Appl. No. 11/836,121, filed Mar. 5, 2010, Final Office Action.
U.S. Appl. No. 11/836,121, filed Jul. 25, 2011, Office Action.
U.S. Appl. No. 11/836,121, filed Dec. 7, 2011, Final Office Action.
U.S. Appl. No. 11/625,677, filed May 6, 2009, Office Action.

(56) References Cited

OTHER PUBLICATIONS

U.S. Appl. No. 11/625,677, filed Mar. 10, 2010, Final Office Action.
U.S. Appl. No. 11/625,677, filed Sep. 23, 2010, Office Action.
U.S. Appl. No. 11/625,677, filed Apr. 14, 2011, Final Office Action.
U.S. Appl. No. 11/625,677, filed Mar. 19, 2012, Office Action.
U.S. Appl. No. 11/625,677, filed Aug. 30, 2012, Office Action.
U.S. Appl. No. 11/836,121, filed Dec. 28, 2012, Office Action.
U.S. Appl. No. 11/625,678, filed Apr. 29, 2013, Office Action.
U.S. Appl. No. 13/533,714, filed Nov. 24, 2014, Notice of Allowance.
U.S. Appl. No. 14/746,583, filed Nov. 15, 2016, Office Action.

* cited by examiner

TRIGGERLESS HANDLE MECHANISM AND SHOCK ABSORBING ELEMENTS FOR BASKETBALL SYSTEM

RELATED APPLICATIONS

This patent application is a continuation, and claims priority to and the benefit, of U.S. patent application Ser. No. 13/533,714 (issued as U.S. Pat. No. 8,992,350), filed on Jun. 26, 2012, and entitled TRIGGERLESS HANDLE MECHANISM AND SHOCK ABSORBING ELEMENTS FOR BASKETBALL SYSTEM (the "'714 Application"). The '714 Application, in turn, claims priority to, and the benefit of, U.S. Provisional Patent Application Ser. 61/502,452 filed on Jun. 29, 2011, entitled TRIGGERLESS HANDLE MECHANISM AND SHOCK ABSORBING ELEMENTS FOR BASKETBALL SYSTEM. All of the aforementioned applications are incorporated herein in their respective entireties by this reference.

BACKGROUND

Field of the Present Disclosure

The present disclosure is generally concerned with basketball systems and more particularly, with basketball systems that may include one or both of a triggerless handle height adjustment mechanism, and one or more shock absorbing elements at least indirectly connecting one element of the basketball system to another element of the basketball system. Yet other embodiments may not include a height adjustment mechanism.

Description of Related Art

A variety of different basketball systems have been constructed, but many suffer from one or more deficiencies. Example embodiments within the scope of this disclosure may thus present one or more advantages relative to other basketball systems. One example of such an advantage may relate to the use, in the basketball system, of one or more shock absorbing elements that are configured and arranged to enable one or more elements of the basketball system to temporarily change position and/or orientation in response to imposition, on the basketball system, of a force such as may be exerted by a player dunking a basketball. Such shock absorbing elements may be employed in basketball systems with, or without, a height adjustment mechanism.

Another example of an advantage that may be presented by one or more embodiments relates to a triggerless handle mechanism employed in a height adjustment mechanism for a backboard of a basketball system. The triggerless handle mechanism may employ relatively fewer and/or less complex parts, and may be easier to operate and/or be relatively more reliable and durable than handle mechanisms employed in some known basketball systems. Examples of height adjustment mechanisms that may be employed in at least some embodiments of the present invention include those within the scope of U.S. Pat. No. 8,062,152 (U.S. patent application Ser. No. 12/192,046), entitled HEIGHT ADJUSTMENT MECHANISM FOR A BASKETBALL SYSTEM, issued on Nov. 22, 2011 (the "'152 Patent"), and incorporated herein in its entirety by this reference.

BRIEF SUMMARY OF SOME ASPECTS OF THE DISCLOSURE

Disclosed embodiments are concerned with a basketball system, and elements of a basketball system. Example embodiments within the scope of this disclosure may include one or more of the following elements, in any combination: a backboard to which a goal is configured to be attached; a support structure; a connecting structure configured to connect a backboard to a support structure; a height adjustment mechanism operably disposed with respect to the backboard; means for absorbing shock, wherein the means may enable movement and/or temporary reorientation of a backboard and/or part of a connecting structure in response to the imposition of a load or force on an associated basketball system; means for absorbing shock, wherein the means enables movement and/or temporary reorientation and/or temporary relocation of one or more elements of a basketball system in response to the imposition of a load or force on the basketball system, where the means is part of a connecting structure that is configured to connect a backboard to a support structure; a basketball system having a non-rigid construction that includes one or more shock absorbing elements; means for absorbing shock, wherein the means enables movement and/or temporary reorientation and/or temporary relocation of one or more elements of the basketball system in response to the imposition of a load or force on the basketball system, and wherein one of the elements is an element other than a goal of the basketball system; one or more shock absorbing elements that may include one or more of a gas spring, a shock, and a spring; one or more shock absorbing elements connected to first and second elements of a basketball system; one or more shock absorbing elements having a first portion configured to be connected either directly or indirectly to a backboard of a basketball system, and having a second portion configured to be connected either directly or indirectly to a support structure of a basketball system; a plurality of shock absorbing elements, where at least two of the shock absorbing elements are located in-line with each other; a height adjustment mechanism at least indirectly connected to the backboard and including a triggerless handle that is operable to enable repositioning of the backboard; a height adjustment mechanism at least indirectly connected to the backboard and including a handle, where the height adjustment mechanism may be locked and/or unlocked solely by a corresponding rotation of the handle; a handle of a height adjustment mechanism, where the handle includes a curved portion configured to slidingly engage a locking pin of a lockable biasing mechanism such that a movement of the handle, such as a rotation, causes a corresponding linear motion of the locking pin to lock and/or unlock the biasing mechanism; a height adjustment mechanism at least indirectly connected to the backboard and including a handle, where the height adjustment mechanism is configured to be locked/unlocked by rotation of the handle, and when the height adjustment mechanism is unlocked, an upward and/or downward force exerted on the handle may effect a change to a height of the backboard; a height adjustment mechanism at least indirectly connected to the backboard and including a handle, where the height adjustment mechanism is configured to be locked/unlocked by rotation of the handle, and when the height adjustment mechanism is unlocked, an upward and/or downward force exerted on the handle may effect a change to a height of the backboard; a connecting structure that connects the backboard to the support structure, the connecting structure including a parallelogram structure configured and arranged to support a backboard and goal; a backboard assembly whose height is substantially fixed relative to an associated playing surface or other reference; a height adjustment mechanism operably disposed with respect to a backboard and configured to substantially retain the backboard at a desired height without the use of a locking mechanism; and, a connecting structure that connects the backboard to the support structure, the connecting structure including a parallelogram structure configured and arranged to support a backboard and goal, and the parallelogram structure includes first and second sets of extension arms configured to move in unison with each other.

It will be appreciated that the aforementioned embodiments do not constitute an exhaustive summary of all possible embodiments, nor does this summary constitute an exhaustive list of all aspects of any particular embodiment (s). Rather, this summary simply presents selected aspects of some example embodiments. It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

BRIEF DESCRIPTION OF THE DRAWINGS

The appended drawings contain figures of some example embodiments to further explain various aspects of the present disclosure. It will be appreciated that these drawings depict only some embodiments of the disclosure and are not intended to limit its scope in any way. The disclosure will be described and explained with additional specificity and detail through the use of the accompanying drawings in which.

DETAILED DESCRIPTION OF SOME EXAMPLE EMBODIMENTS

Figure 1:
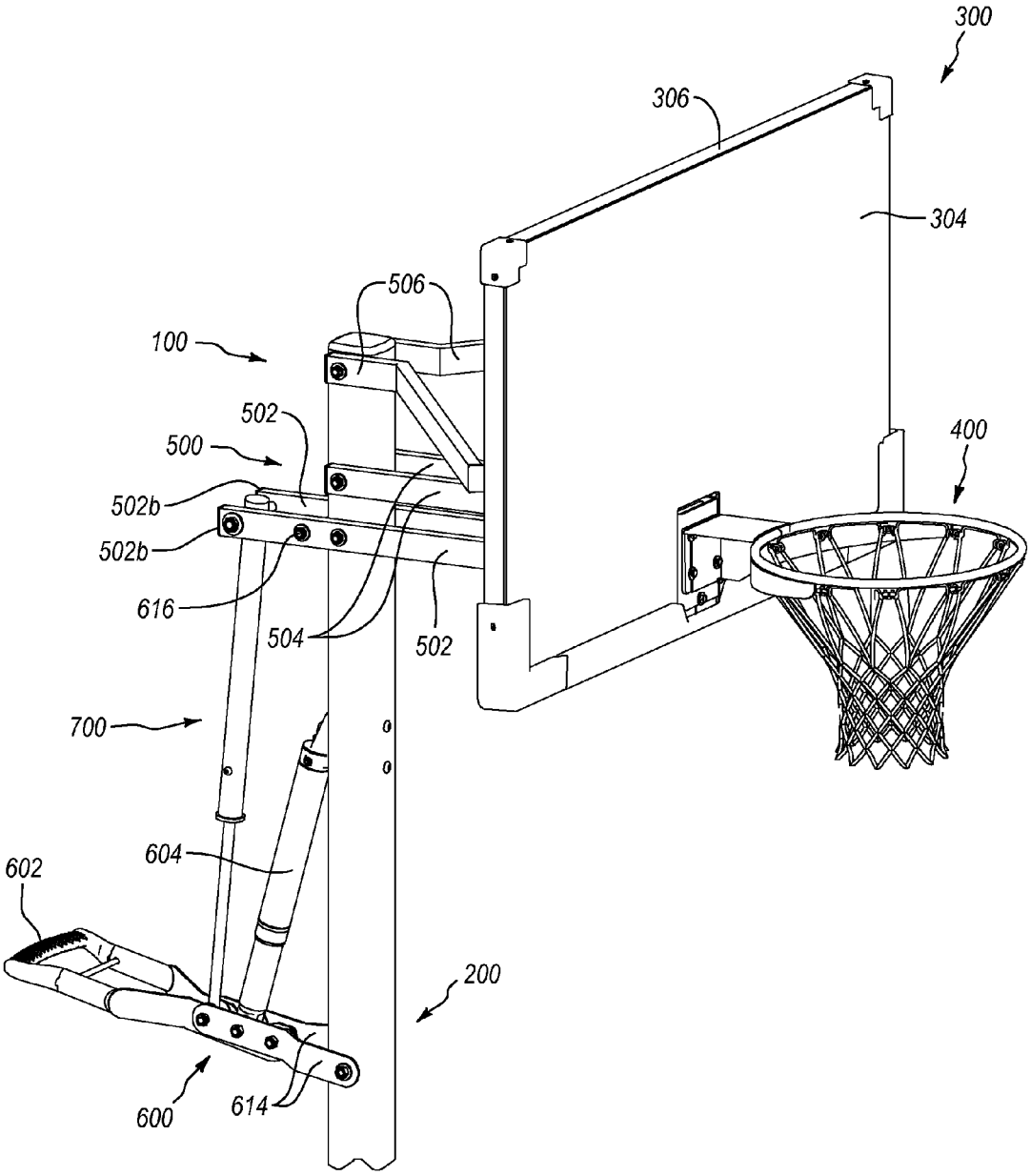
FIG. 1 is a partial front perspective of an example basketball system, illustrating a backboard, a connecting structure, a support structure, and height adjustment mechanism.

The present disclosure is generally concerned with basketball systems and their components.

A. General Aspects of Some Example Embodiments

In general, basketball system components disclosed herein may be constructed with a variety of components and materials including, but not limited to, plastic (including blow-molded plastic structures and elements), including polycarbonates, composites, metals, and combinations of any of the foregoing. Suitable metals may include steel, aluminum, and aluminum alloys, although the skilled person will understand that a variety of other metals may be employed as well and the scope of the invention is not limited to the foregoing examples. Where metal is employed in the construction of a basketball system component, the metal elements may take one or more forms including, but not limited to, pipe, square tube, rectangular tube, round tube, pipe, angles, flatbar, I-shapes, T-shapes, L-shapes, and combinations and portions of any of the foregoing.

Depending upon the material(s) employed in the construction of the basketball system, a variety of methods and components may be used to connect, releasably or permanently, various elements of the basketball system. For example, the various elements of a basketball system or basketball system component within the scope of this disclosure may be attached to each other by any one or more of allied processes such as welding or brazing, and/or mechanically by way of fasteners such as bolts, screws, pins, and rivets, for example.

Some, none, or all of portions of a one or more of the basketball system components may be coated or otherwise covered with paint, rubber, plastic or other materials, or any combination of the foregoing. Surface treatments and textures may also be applied to portions of the basketball system. At least some of such materials may serve to help prevent, or reduce, rust and corrosion.

B. Structural Aspects of Some Example Embodiments

Although not specifically illustrated in the Figures, embodiments of the basketball system may include a base configured to support the support structure (discussed below). The support structure may be removably attached to the base using one or more support members. The base and/or the support structure may include one or more wheels, rollers or other devices configured and arranged to aid in the portability of the basketball system. The base may be constructed of blow-molded plastic and define a substantially hollow interior that can be filled with a ballast material such as water or sand, for example. In some embodiments, the base may be configured such that auxiliary base units, which may be substantially hollow or substantially solid, can be removably attached to the base. The solid auxiliary base units may be made of materials such as steel or concrete. As noted elsewhere herein however, the scope of this disclosure extends to permanently installed basketball systems as well and is not limited to portable basketball systems.

Figure 2:
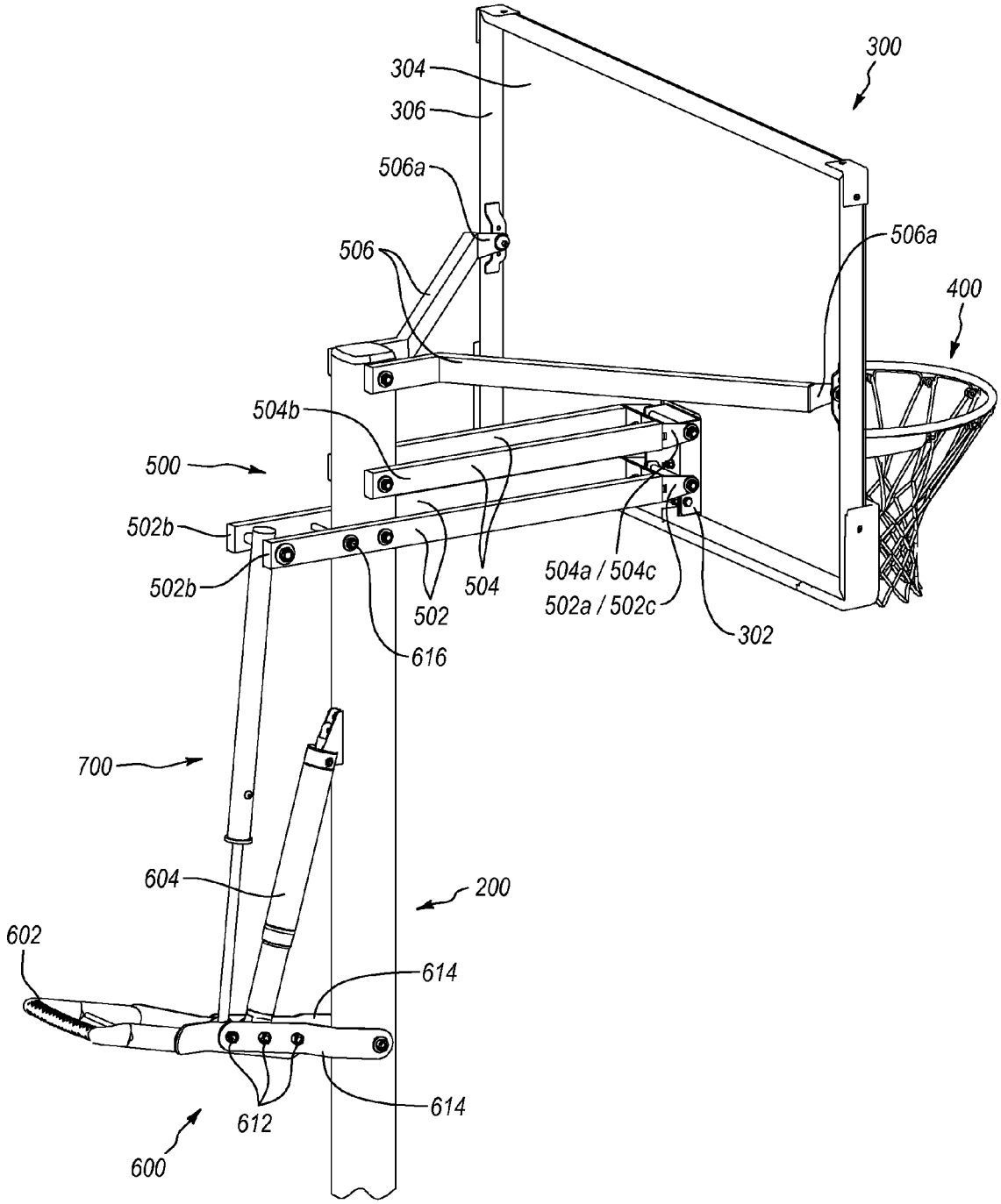
FIG. 2 is a partial rear perspective of an example basketball system, illustrating a backboard, a connecting structure, a support structure, and height adjustment mechanism.

Directing attention initially to FIGS. 1 and 2, aspects of an example basketball system 100 are disclosed. In the disclosed example, the basketball system 100 includes a support structure 200, such as a post for example, and a backboard assembly 300 having a goal 400. The backboard assembly 300 is connected to the support structure 200 by way of a connecting structure 500. A height adjustment mechanism 600 enables a user to adjust the vertical position of the backboard assembly 300 and goal 400. Finally, a shock absorbing element 700 is provided that is connected to respective first and second portions of the basketball system 100. As discussed elsewhere herein, one or more shock absorbing elements may also be employed in basketball systems whose backboard assembly has a substantially fixed, that is, non-adjustable, height relative to some reference, such as a playing surface.

In the example of FIGS. 1 and 2, the connecting structure 500 includes one or more extension arms 502 and 504 that are rotatably connected at one end 502*a* and 504*a*, respectively, to a bracket 302 which, in turn, is attached to a backboard 304 of the backboard assembly 300. The backboard may comprise any suitable material, examples of which include plastic, fiberglass, and blow molded plastic. As discussed in further detail below, the bracket 302 may be connected to the goal 400.

Thus configured and arranged, the extension arms 502 and 504 are able to rotate relative to the backboard assembly 300. In the example of FIGS. 1 and 2, the extension arms 502 are relatively longer than extension arms 504, although in alternative embodiments, the extension arms 502 and 504 may have substantially the same length as each other. As is evident from the example of FIGS. 1 and 2, the extension arms 502 and 504 may collectively form a parallelogram structure that, among other things, serves to support the backboard assembly 300 and goal 400.

As further indicated in FIGS. 1 and 2, the extension arms 502 and 504 are connected to the bracket 302 and the support structure 200 in such a way that the extension arms 502 and 504 are parallel to each other, and are able to move in unison with each other while maintaining their parallel orientation relative to each other. Particularly, extension arms 502 are rotatably connected, such as by a bolt or pin for example, not only to the bracket 302 but also to the support structure 200 at a point on the extension arms 502 between end 502*a* and end 502*b*. Similarly, extension arms 504 are rotatably attached not only to the bracket 302 but also to the support structure 200 at end 504*b*, by way of a device such as a bolt or pin for example. As indicated in the figures, the sets of extension arms 502 and 504 may respectively incorporate, or be connected to, brackets 502*c* and 504*c* that enable the extension arms 502 and 504 to rotate relative to the bracket 302.

Finally, the backboard assembly 300 may also be supported by a pair of backboard support arms 506. Similar to the case of the extension arms 502 and 504, the backboard support arms 506 are rotatably connected, such as by way of a pin or bolt for example, to a frame 306 of the backboard assembly 300 and the support structure 200. Thus configured and arranged, the backboard support arms 506 are able to move in unison with the extension arms 502 and 504 as the backboard assembly 300 is raised and lowered. As in the case of the sets of extension arms 502 and 504, the backboard support arms 506 may incorporate, or be connected to, brackets 506*a* that enable the backboard support arms 506 to rotate relative to the bracket 302.

By virtue of their attachment to side portions of the frame 306, at a location which may be about midway between upper and lower edges of the frame 306, the backboard support arms 506 may provide an additional measure of support to the backboard assembly 300 and, more particularly, to an upper portion of the backboard assembly 300.

Figure 3:
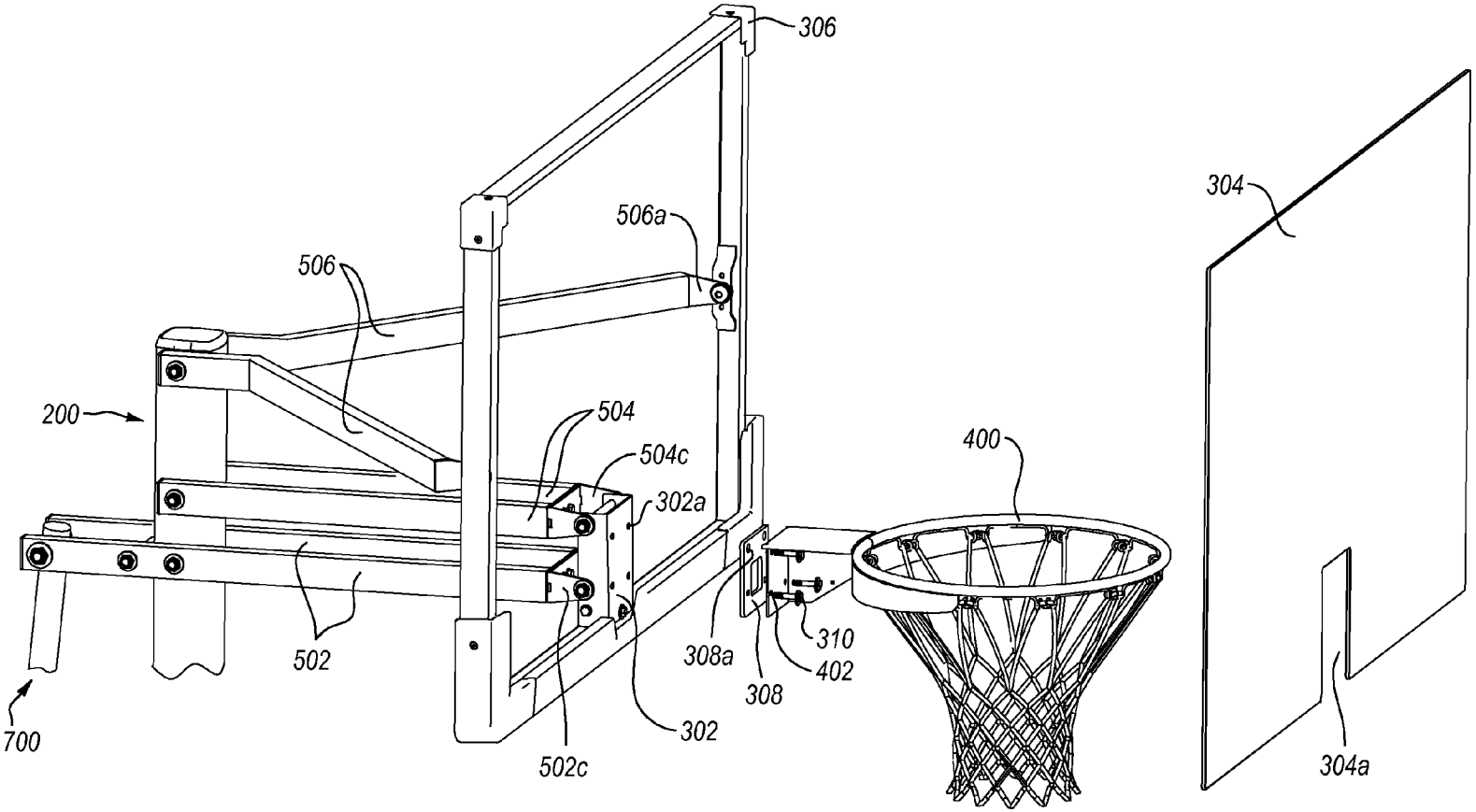
FIG. 3 is a partial exploded view of an example basketball system, illustrating a backboard, backboard frame, and a connecting structure.

Directing particular attention now to FIG. 3, and as noted earlier, the bracket 302 may be attached, directly or indirectly, to the goal 400. In the example of FIG. 3, a spacer 308 is provided that is positioned between the bracket 302 and the goal 400. The spacer 308 may be made of metal, or other suitable material. The backboard 304 may include a cutout 304*a* that fits around the bracket 302 and spacer 308. The goal 400, spacer 308, and bracket 302 may each include respective holes 402, 308*a*, and 302*a*, through which a fastener 310, such as a bolt for example, is passed. By passing the fasteners 310 through these holes, and securing the fasteners 310 with nuts (not shown), the goal 400 can be securely attached to the bracket 302. Moreover, because the goal 400 is not directly connected to the backboard 304, forces and loads imposed on the goal 400 may be relatively less likely to cause damage to the backboard 304.

C. Example Height Adjustment Mechanisms

With continued attention to FIGS. 1 and 2, and directing attention as well now to FIGS. 4-8, further details are provided concerning the example height adjustment mechanism 600. As indicated in the Figures, the height adjustment mechanism 600 includes a handle 602 that may be connected directly or indirectly to the support structure 200, and to the connecting structure 500, as discussed in further detail below.

In at least one embodiment, one or more elements of the height adjustment mechanism 600, such as the handle 602 for example, may be connected, either directly or indirectly, to the support structure 200 and/or other elements of the basketball system 100 by one or more biasing mechanisms 604. Additional or alternative elements of the height adjustment mechanism 600 may be connected, either directly or indirectly, to portions of the basketball system by one or more biasing mechanisms 604. In some instances, the biasing mechanism(s) need not be directly connected to the handle 602 or to other portions of the height adjustment mechanism.

The biasing mechanism 604 may take the form of one or more springs or shocks, or other element(s) of comparable functionality, or combinations thereof. Where multiple springs and/or shocks are employed, one or more springs and/or shocks may be arranged in parallel with each other. Alternatively, one or more springs and/or shocks may be arranged in-line, that is, serially, with each other. In the example disclosed in the Figures, the biasing mechanism 604 may be rotatably connected to the support structure 200 and the handle 602, although such an arrangement and configuration is not necessary. Such rotatable connections may permit, among other things, the biasing mechanism 604 to change position and orientation as the height of the backboard assembly 300 is adjusted.

As well, and as discussed in more detail elsewhere herein, the biasing mechanism 604 may be lockable so that it can be selectively locked and unlocked. When locked, for example, the biasing mechanism 604 may aid in the retention of the backboard assembly 300 in a desired position by preventing substantial motion of the handle 602 to which the connecting structure 500 is connected. When unlocked, the biasing mechanism 604 may bias the backboard assembly 300 in a desired direction, such as upwardly for example, by acting on the handle 602, downwardly for example, in such a way as to move the handle 602 in a direction that causes, or tends to cause, a corresponding motion of the backboard assembly 300 in the desired direction. An upward bias of the backboard assembly 300 may be particularly desirable in some instances, as such a bias tends to move the backboard assembly 300 away from the user, rather than toward the user, when the biasing mechanism 604 is unlocked. As well, such an upward bias may reduce the amount of effort required by a user to raise the backboard assembly 300 to a relatively higher position.

In yet other embodiments, a height adjustment mechanism may be employed that is not lockable and/or that is configured such that it does not require a lock. The crank mechanism of the example embodiment of FIG. 13, discussed below, is one example of such a height adjustment mechanism. Due to friction, weight of the backboard, inertia and/or other considerations, the crank mechanism may tend to retain a backboard at a desired position until such time as a user operates the crank mechanism to change the backboard position. This retention, or substantial retention, of the backboard at a particular position may be achieved without the use of a lock, due to considerations such as those noted above.

In at least some embodiments, the biasing mechanism 604 constitutes the biasing mechanism of the '152 Application. Moreover any of the height adjustment mechanisms of the '152 Application may be employed in combination with one or more of the other basketball system components, devices and elements disclosed herein to define various additional embodiments.

Figure 6:
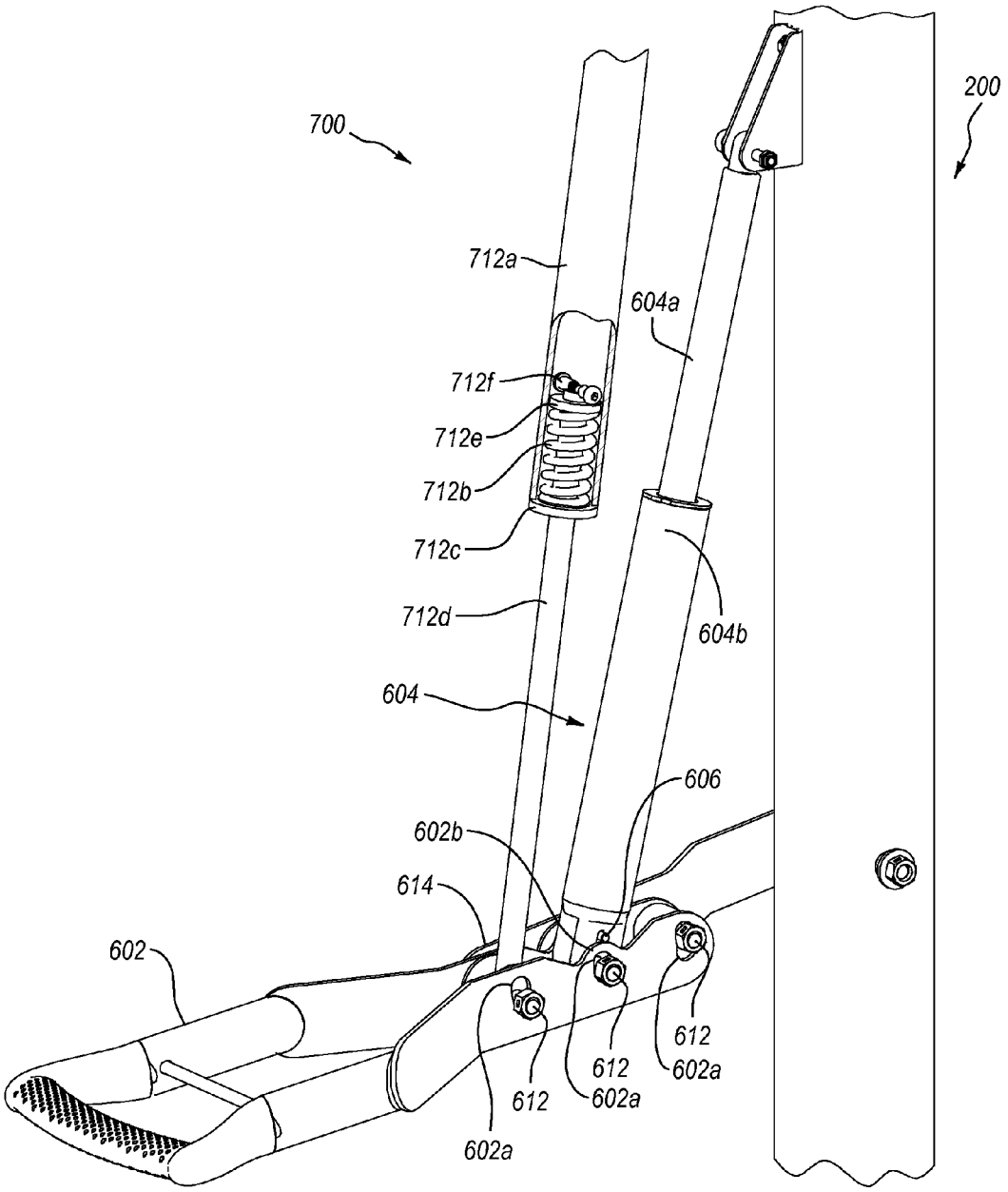
FIG. 6 is a partial rear perspective view of an example basketball system, illustrating a shock absorbing element and a height adjustment mechanism in an unlocked position.
Figure 7:
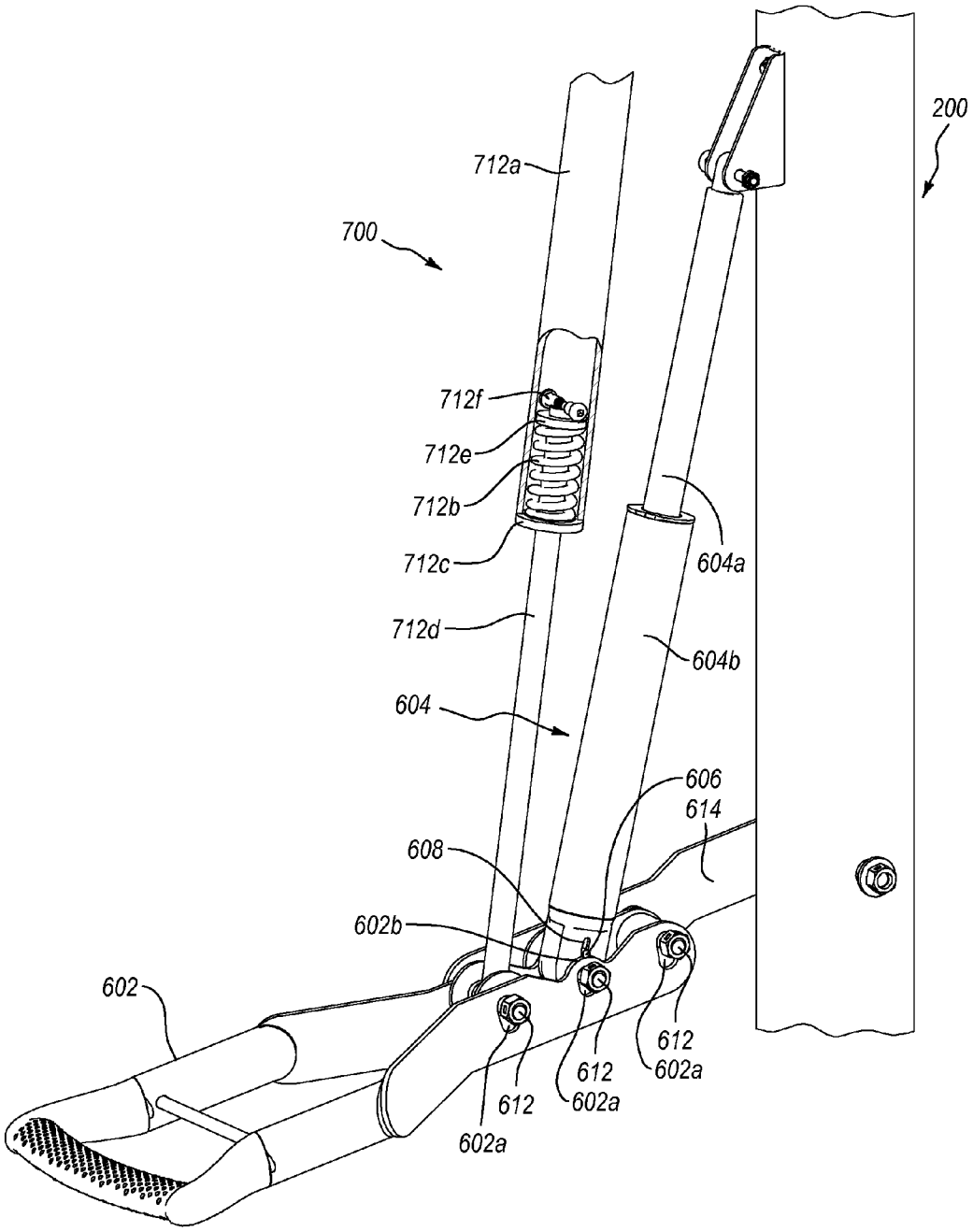
FIG. 7 is a partial rear perspective view of an example basketball system, illustrating a shock absorbing element and a height adjustment mechanism in a locked position.
Figure 8:
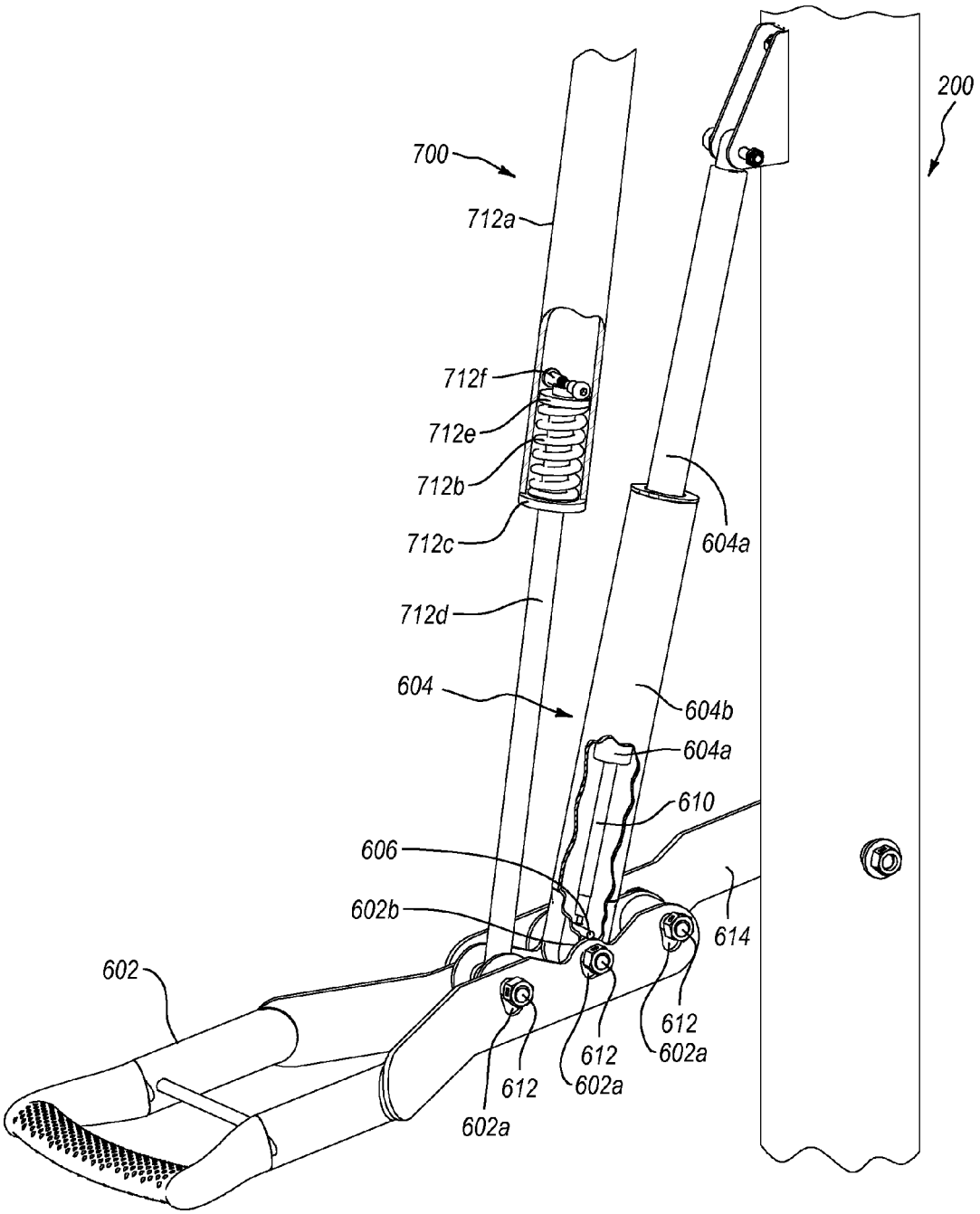
FIG. 8 is a partial rear perspective view of an example basketball system, illustrating a shock absorbing element and a partial cutaway of a height adjustment mechanism in an unlocked position, including a locking pin.

With particular reference to FIGS. 6-8, further details are provided concerning the operation of the handle 602 and biasing mechanism 604. As explained above, the biasing mechanism 604 may be lockable. One example of such a biasing mechanism 604 includes a locking pin 606 having a generally linear range of motion defined by a slot 608 of the biasing mechanism 604. Thus configured and arranged, the locking pin 606 is able to effect a reciprocal motion of a pin 610 between a locked and unlocked position. When the pin 610 is in the unlocked position, best shown in FIGS. 6 and 8, a rod 604*a* of the biasing mechanism 604 and a housing 604*b* of the biasing mechanism 604 are able to move linearly relative to each other. When the housing 604*b*, attached to the handle 602, is thus unconstrained, the handle 602 can be moved so as to manipulate the connecting structure 500 and, accordingly, the height of the backboard assembly 300 to which the connecting structure 500 is connected.

As further indicated in FIGS. 6-8, movement of the locking pin 606 may be effected by motion, which may be rotational at least in part, of the handle 602. In the illustrated example, the handle 602 defines, on each side, a plurality of slots 602*a*, each of which receives a corresponding pin 612, which may take the form of a bolt, stud, shaft, rivet, or other similar device. The middle pin 612 serves, at least in part, to rotatably connect the biasing mechanism 604 to the handle 602, while the left-most pin 612 serves, at least in part, to rotatably connect the shock absorbing element 700 to the handle 602. The pins 612 also connect the handle 602 to a pair of connecting arms 614 (one is removed for clarity) which, in turn, are rotatably connected to the support structure 200. Among other things, the connecting arms 614 may position the handle sufficiently far away from the support structure 200 that the handle 602 is able to freely operate, and so that the mechanical advantage provided by the handle 602 can be advantageously employed.

As is apparent from FIGS. 6 and 7, for example, the configuration and arrangement of the slots 602*a* and pins 612 is such as to enable a range of linear motion of the handle 602, as well as a range of rotational motion of the handle 602. As to the latter, for example, the range of motion enabled collectively by the left and right-most slots 602*a* permit the handle 602 to rotate about the pin 612 located in the center slot 602*a*. The rotational and/or linear motion of the handle 602 that may be enabled by the aforementioned configuration may permit a user to effect locking and unlocking of the biasing mechanism 604 by a corresponding movement of the handle 602.

More particularly, the handle 602 may include one or more cam surfaces that include a curved portion 602*b* in sliding contact with the locking pin 606 so that, upon rotation of the handle 602, the rotary motion of the cam surface(s) 602*b* may result in a corresponding linear motion of the locking pin 606 into, or out of, as applicable, a locked or unlocked position. Additionally, or alternatively, a linear motion of the cam surface(s) 602*b* may result in a corresponding linear motion of the pin 610 into, or out of, as applicable, a locked or unlocked position. Thus, the linear motion of the locking pin 606 used for locking and/or unlocking of the biasing mechanism 604 may be effected by one or both of a rotary motion and a linear motion of the handle 602.

Finally, and as apparent from the figures and preceding discussion, at least some embodiments of the handle 602 are of a triggerless configuration, so that a user can lock or unlock the biasing mechanism 604 simply by an appropriate movement of the handle 602. Thus configured, the handle 602 permits both unlocking of the biasing mechanism and raising/lowering of the backboard assembly 300 to be effected with a single movement of the handle.

D. Example Shock Absorbing Elements and Arrangements

With continued reference to the example of FIGS. 6-8, and with reference again to FIGS. 4-5, one or more shock absorbing elements 700 may be provided in example embodiments of the invention. In general, the shock absorbing elements, configurations and arrangements disclosed herein can be employed in virtually any basketball system, whether portable, or permanently installed, and whether including a height adjustment mechanism, or not.

With particular reference now to the figures, the example shock absorbing element 700 may be connected, and rotatable with respect, to a pin 612, as noted elsewhere herein. Thus configured and arranged, the shock absorbing element 700 is able to rotate relative to the handle 602, while also being responsive to movement of the handle 602. In addition to being connected to the handle 602, the shock absorbing element 700 may also be connected to other elements of the basketball system 100 such as, for example, the extension arms 502/504. In the example of FIGS. 4-8, the shock absorbing element 700 serves to interconnect the handle 602 with the connecting structure 500, although such an arrangement is not required.

At least some embodiments may include more than one shock absorbing element 700. Still other embodiments may include one or more shock absorbing elements 700, and also one or more springs or other elements (not shown) connected to the goal 400 and backboard assembly 300 and that bias the goal 400 into a desired position, but which allow the position of the backboard assembly 300 to be temporarily modified, such as when a player dunks a basketball.

The location and orientation of the shock absorbing element 700 that is indicated in the Figures is provided by way of illustration only. In fact, one or more shock absorbing elements may be employed in a variety of ways in embodiments of the basketball system. For example, shock absorbing elements 700 may be employed with, or in place of, one or more of extension arms 504, extension arms 502, and backboard support arms 506. As but one example, the extension arms 502 may each be replaced by a respective shock absorbing element in compression. As discussed below, other configuration may likewise be employed.

Depending upon variables such as, but not limited to, the orientation, location, and connection configuration of the shock absorbing element 700, the shock absorbing element 700 may be configured so that in its resting, or steady, state, condition, the shock absorbing element 700 is in compression. Alternatively, the shock absorbing element 700 may be configured so that in its resting, or steady, state, condition, the shock absorbing element 700 is in tension. At least some embodiments employ one or more shock absorbing elements 700 configured and arranged so that, in their steady state, they are in tension, and/or one or more shock absorbing elements 700 configured and arranged so that, in their steady state, they are in compression.

In some example embodiments, the shock absorbing element 700 comprises a gas spring, or a spring. In other embodiments, the shock absorbing element 700 may comprise both a gas spring and a spring. It will be appreciated that shock absorbing elements such as gas springs and springs are example structural implementations of a means for absorbing shock. More generally however, any other element(s) that are operable of providing one or more aspects of the functionality of shock absorbing element 700 may likewise be employed in one or more embodiments of the invention.

Functionality implemented by the means for absorbing shock may include, for example, performing or enabling any of the following, in any combination: temporary displacement of the backboard in response to imposition of a load or force on the backboard if the imposed load or force exceeds a threshold load or force, respectively, where the displacement may or may not be generally proportional to the load and/or force exerted; a temporary vertical displacement of the backboard in response to imposition of the load or force on the backboard if the imposed load or force exceeds the threshold load or force, respectively; temporary displacement of a portion of the connecting structure in response to the imposition of the load or force on the backboard, if the imposed load or force exceeds the threshold load or force, respectively; one or both of a downward movement of the backboard and movement of the backboard toward the support structure in response to the imposition of a load or force on the basketball system, if the imposed load or force exceeds the threshold load or force, respectively; automatic return of the backboard to its position prior to imposition of the load or force, upon removal of a force or load exceeding the threshold force or load, respectively; and, a damping effect in response to imposition of the force or load on the basketball system.

With particular reference now to the structure of the example shock absorbing element 700, and directing attention particularly to FIGS. 5-8, that device is rotatably connected to the ends 502*b* of the extension arms 502 and to the handle 602, as previously discussed. In the illustrated example, the shock absorbing element 700 includes a tube 712*a* within which a resilient element 712*b*, such as a spring, is confined. In one example, the lower end of the tube 712*a* is partially closed with a cap 712*c*, such as with a welded metal disk for example, so as to prevent the resilient element 712*b* from falling out of the tube 712*a*, and to provide a surface to compress the resilient element 712*b*.

A rod 712*d* extends into the tube 712*a*, passing through the resilient element 712*b* and including a compression element 712*e* attached proximate a terminal end of the rod 712*d* so that the resilient element 712*b* is confined between the cap 712*c* and the compression element 712*e*. In general, the rod 712*d* is configured for reciprocating linear motion within the housing 712*a*, with the range of motion of the rod 712*d* being defined by the cap 712*c* and a stop 712*f*, such as a pin for example, disposed in the tube 712*a* and connected to the tube 712*a*.

In general, motion of the tube 712*a* away from the handle 602, such as may occur in response to imposition of a force and/or load on the backboard assembly 300 to which the handle 602 is connected by way of the connecting structure 500, causes the cap 712*c* to compress the resilient element 712*b* against the compression element 712*e*. Thus, when the biasing mechanism 604 is locked, the resilient element 712*b* permits, but is resistant to, movement of the backboard assembly 300 in response to the force or load imposed.

In general, the extent to which the shock absorbing element 700 resists such motion of the backboard assembly 300 can be varied, for example, by selection of, and/or adjustments to, a spring constant 'k' that is characteristic of an element such as resilient element 712*b*. In this regard, the shock absorbing element 700 may be configured such when the biasing mechanism 604 is locked, little or no motion of the backboard assembly 300 will occur unless, or until, a force or load is imposed on the backboard assembly 300 that exceeds a threshold force or load, which may be defined at least in part by an element such as the resilient element 712*b*. Thus, while the basketball system 100 is otherwise relatively rigid when the biasing mechanism 604 is locked, the shock absorbing element 700 permits a limited range of motion of the backboard assembly 300 when certain defined conditions are present.

It should be noted that the response of the shock absorbing element 700, which need not be a spring or shock, to imposition of forces and/or loads exceeding the respective thresholds, or not, may be linear, or non-linear. In some instances, the shock absorbing element 700 may be tunable by a user so that the user can customize the response of the backboard assembly 300 to the imposition of forces and loads.

E. Some Example Modifications

It will be appreciated that various modifications to the example arrangement disclosed in the figures are possible. Any one of these modifications can be employed with any other embodiment disclosed herein, or contemplated by this disclosure.

In one alternative arrangement, for example, the biasing mechanism 604 and the shock absorbing element 700 may be attached to the handle 602 at a common point. This attachment may be effected with the use of a pin, bolt, rivet, or other similar device.

In another example of a modification that may be employed, the positions of the biasing mechanism 604 and the shock absorbing element 700 may be switched so that, with reference to FIG. 1 for example, the biasing mechanism 604 is located where the shock absorbing element 700 is shown, and the shock absorbing element 700 is located where the biasing mechanism 604 is shown.

Yet another modification that may be employed is the modification of the arrangement of FIG. 1 to additionally include a gas spring, or comparable device(s), located in-line with the shock-absorbing mechanism 700, such that the resulting apparatus would include the gas spring (or other device(s)) in addition to the shock-absorbing mechanism 700, and the biasing mechanism 604.

It should also be noted that while the shock absorbing element 700 and the height adjustment mechanism 600 are illustrated as being used in connection with portable basketball systems, the scope of this disclosure is not so limited. In fact, any or all of the basketball system features disclosed herein may be employed in connection with a static or permanently installed basketball systems.

F. Operational Aspects of Some Example Embodiments

Figure 4:
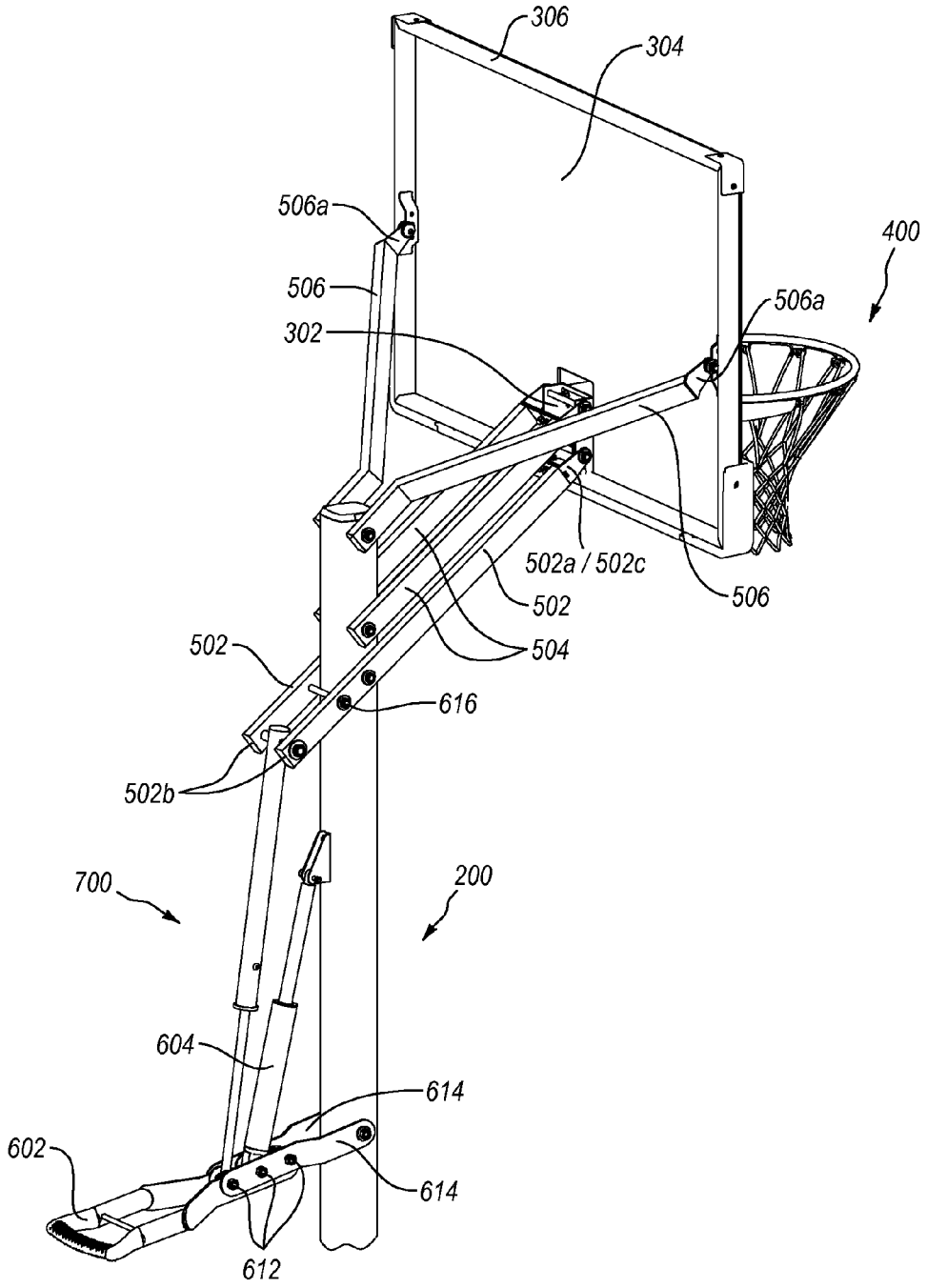
FIG. 4 is a rear perspective view of an example basketball system, illustrating a backboard in a raised position, a connecting structure, a support structure, and height adjustment mechanism.
Figure 5:
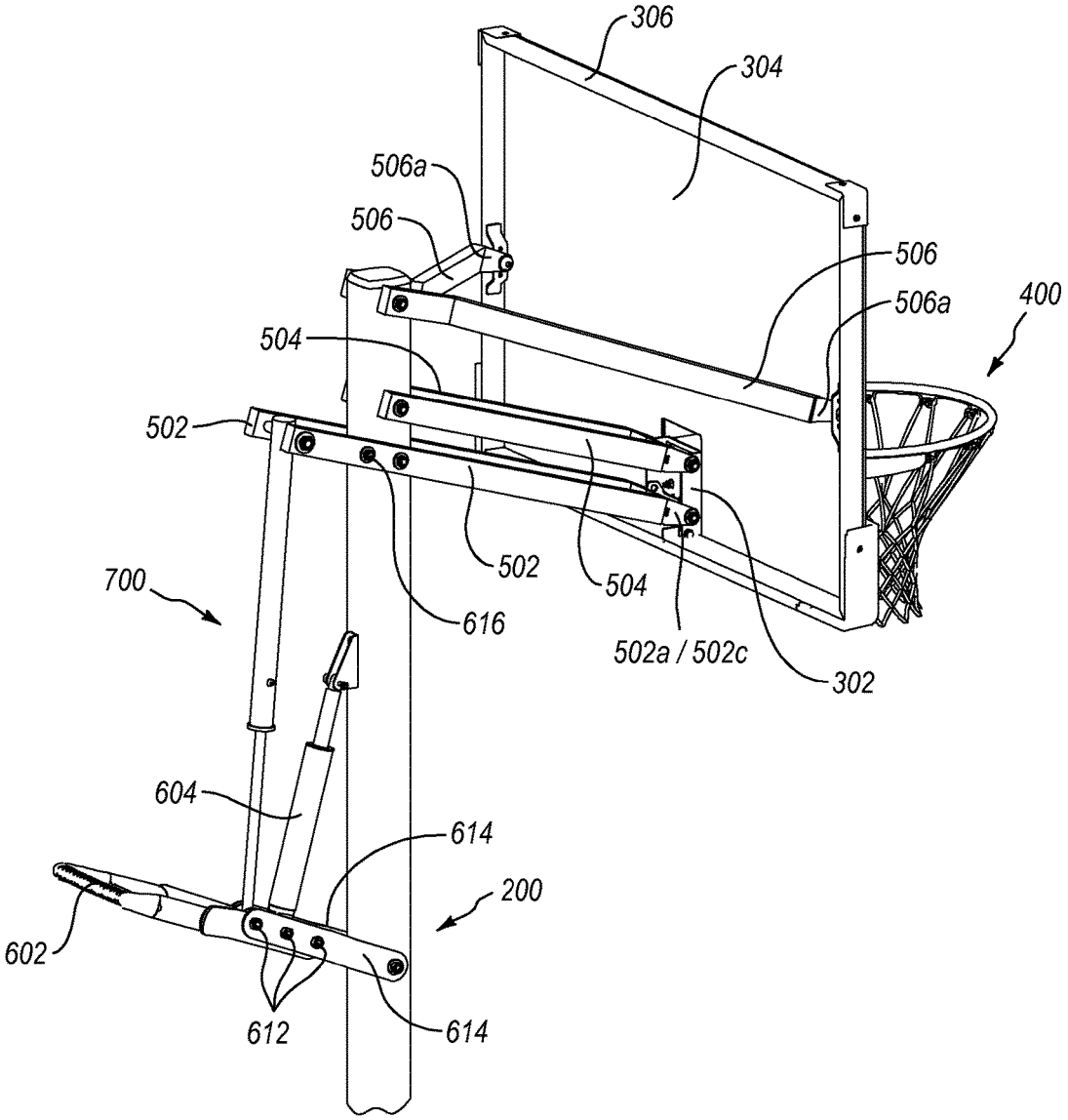
FIG. 5 is a rear perspective view of an example basketball system, illustrating a backboard in a lowered position, a connecting structure, a support structure, and height adjustment mechanism.

In operation, the handle 602 can be raised or lowered by the user so as to cause a corresponding movement of the backboard assembly 300. More particularly, movement of the handle 602 upward may cause the backboard assembly 300 to move vertically down, and toward the support structure 200, as indicated in FIG. 5 for example. Correspondingly, movement of the handle 602 downward may cause the backboard assembly 300 to move vertically up, and away from the support structure 200, as indicated in FIG. 4 for example. With particular reference to FIGS. 4 and 5, some embodiments may include a pin 616 configured and positioned to limit the extent to which extension arms 502 can rotate relative to the support structure 200. The pin 616 may thus define a minimum and/or maximum elevation of the backboards assembly 300. As well, the pin 616 may serve as a safety device by limiting the extent to which the backboard assembly can descend in the event of the failure of, for example, the biasing mechanism 604 and/or the shock absorbing element 700.

Once the backboard assembly 300 is fixed in the desired position, it can be locked in place. With the backboard assembly 300 thus secured, the basketball system 100 is ready for use. Details concerning the operation of height adjustment mechanisms are disclosed in detail in the '152 Application.

G. Structural and Operational Aspects of Other Example Embodiments

Figure 9:
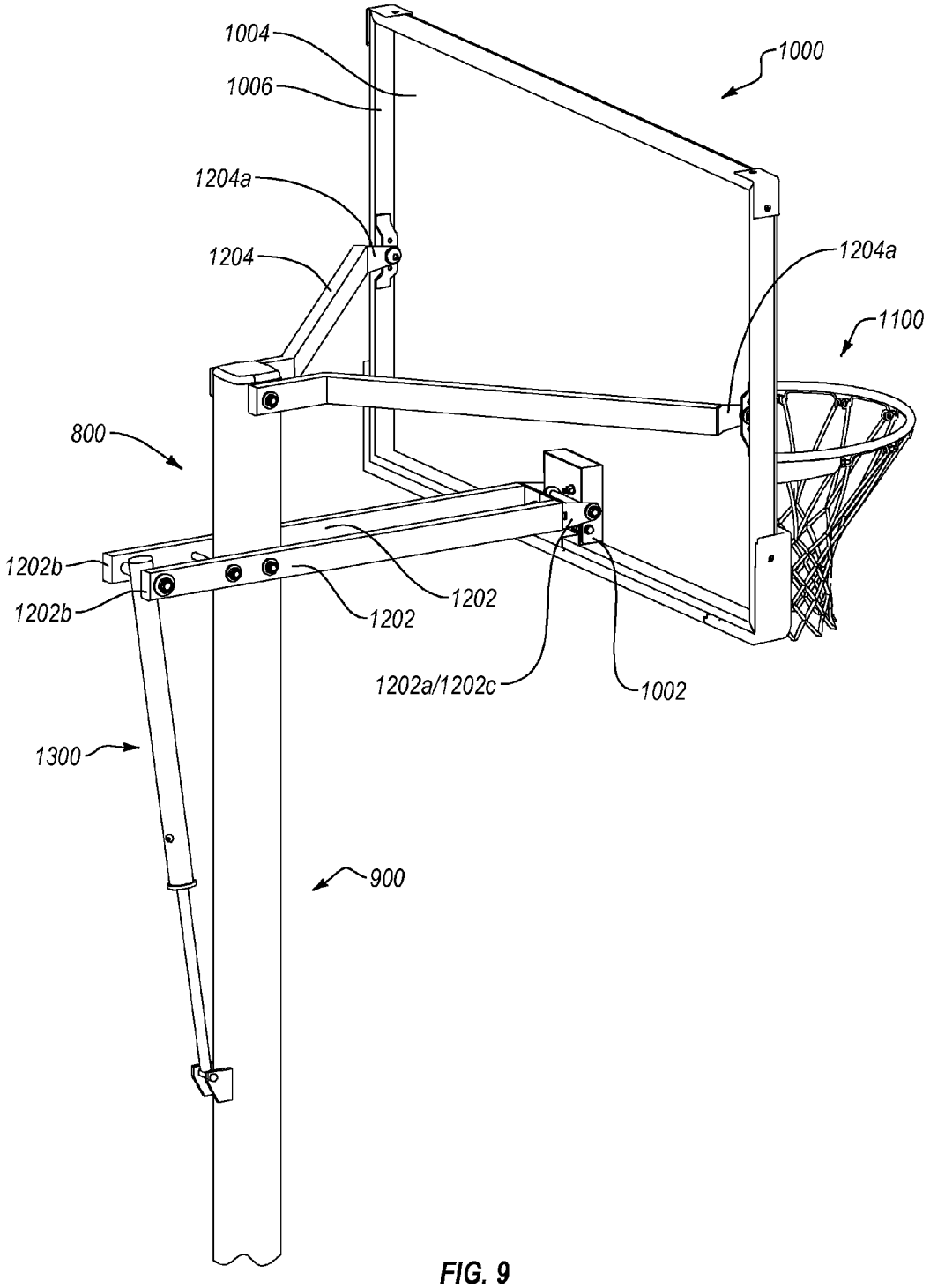
FIG. 9 is a side view of an example basketball system with a fixed height backboard assembly.

Directing attention now to FIG. 9, details are provided concerning aspects of the structure and operation of a basketball system 800 with a backboard assembly whose height is substantially fixed, that is, non-adjustable. In the disclosed example, the basketball system 800 includes a support structure 900, such as a post for example, and a backboard assembly 1000 having a goal 1100. The backboard assembly 1000 is connected to the support structure 900 by way of a connecting structure 1200. Finally, a shock absorbing element 1300 is provided that is connected to respective first and second portions of the basketball system 800.

In the example of FIG. 9, the connecting structure 1200 includes one or more extension arms 1202 that are rotatably connected at one end 1202*a*, respectively, to a bracket 1002 which, in turn, is attached to a backboard 1004 of the backboard assembly 1000. The backboard may comprise any suitable material, examples of which include plastic, fiberglass, and blow molded plastic. Similar to other embodiments discloses herein, the bracket 1002 may be connected to the goal 1100.

Thus configured and arranged, the extension arms 1202 are able to rotate relative to the backboard assembly 1000. In the example of FIG. 9, the extension arms 1202 are relatively longer than backboard support arms 1204 (discussed below), although in alternative embodiments, the extension arms 1202 and backboard support arms 1204 may have substantially the same length as each other. As is evident from the example of FIG. 9, the extension arms 1202 and backboard support arms 1204 may collectively form a parallelogram structure that, among other things, serves to support the backboard assembly 1000 and goal 1100.

As further indicated in FIG. 9, the extension arms 1202 and backboard support arms 1204 are connected to the bracket 1002 and the support structure 900 in such a way that the extension arms 1202 and backboard support arms 1204 are parallel to each other, and are able to move in unison with each other while maintaining their parallel orientation relative to each other. Particularly, extension arms 1202 are rotatably connected, such as by a bolt or pin for example, not only to the bracket 1002 but also to the support structure 900 at a point on the extension arms 1202 between end 1202*a* and end 1202*b*.

Similar to the case of the extension arms 1202, the backboard support arms 1204 are rotatably connected, such as by way of a pin or bolt for example, to a frame 1006 of the backboard assembly 1000 and the support structure 900. Thus configured and arranged, the backboard support arms 1204 are able to move in unison with the extension arms 1202 in the event that the backboard assembly 1000 moves in response to imposition of a load or force. As in the case of the sets of extension arms 1202, the backboard support arms 1204 may incorporate, or be connected to, brackets 1204*a* that enable the backboard support arms 1204 to rotate relative to the bracket 1002.

By virtue of their attachment to side portions of the frame 1006, at a location which may be about midway between upper and lower edges of the frame 1006, the backboard support arms 1204 may provide an additional measure of support to the backboard assembly 1000 and, more particularly, to an upper portion of the backboard assembly 1000.

With regard to the shock absorbing element 1300, at least one embodiment is substantially the same as shock absorbing element 700, and operates in substantially the same fashion. However, as noted above, the embodiment of FIG. 9 does not include a height adjustment mechanism. Rather, except for any movement that may be permitted by the shock absorbing element 1300, the basketball system 800 is substantially rigid, and the backboard assembly 1000 resides at a substantially fixed height relative, for example, to an associated playing surface.

Thus, in the embodiment of FIG. 9, the shock absorbing element 1300 may have a first portion connected, either directly or indirectly, to the connecting structure 1200, and the shock absorbing element 1300 may have a second portion connected, either directly or indirectly, to the support structure 900. The first and second portions of the shock absorbing element 1300 may be rotatably connected, directly or indirectly, to the connecting structure 1200 and the support structure 900, respectively. Thus configured, the basketball system 800 is substantially rigid, and movement of one or more of the backboard assembly 1000, connecting structure 1200, and/or shock absorbing element 1300 may occur only when a force and/or load exceeding a threshold force and/or load, respectively, is/are imposed on a portion of the basketball system 800, such as the backboard assembly 1000 or goal 1100 for example.

Figure 10:
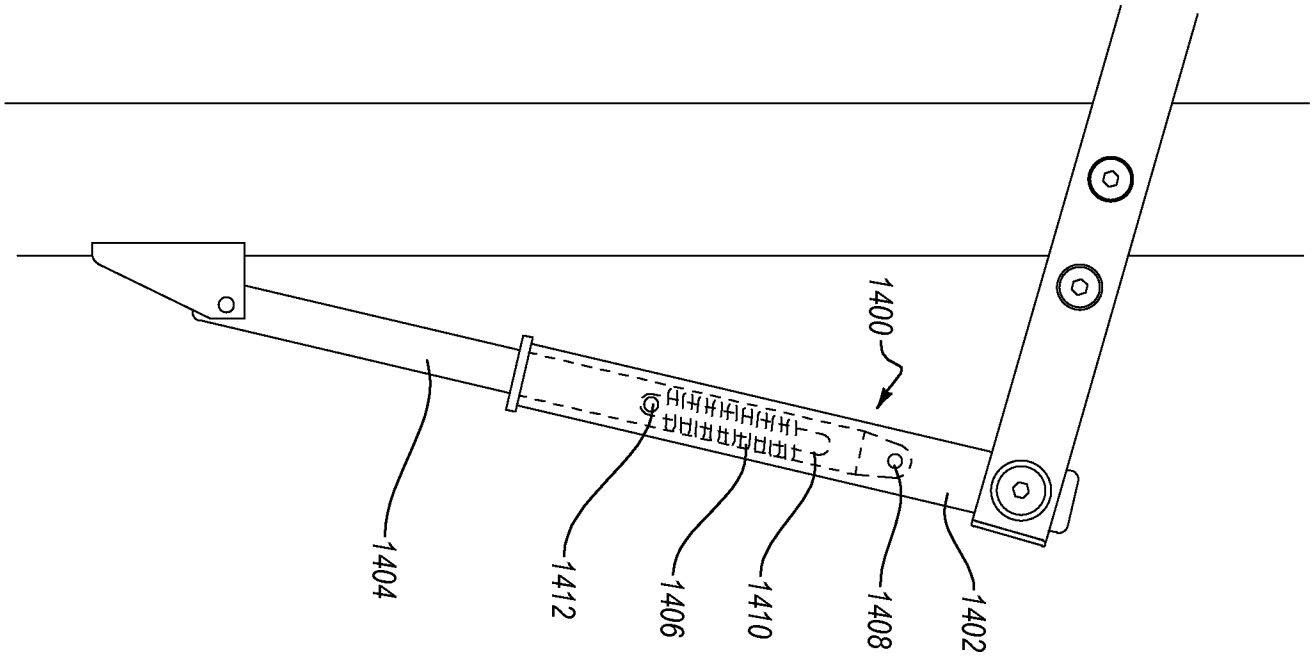
FIG. 10 is a detail view of an example basketball system having a shock absorbing element.

With attention now to FIG. 10, an arrangement similar to that of FIG. 9 is disclosed which employs another example of a shock absorbing element, denoted generally at 1400. As the operational principles of shock absorbing element 1400 are similar, and possibly identical, to those of shock absorbing element 700 and/or shock absorbing element 1300, the following discussion focuses primarily on the structural configuration of the shock absorbing element 1400.

In the example of FIG. 10, the shock absorbing element 1400 includes an outer tube 1402 within which an inner tube 1404 is slidingly received. The outer tube 1402 may be connected either directly or indirectly to various portions of the basketball system, such as the connecting structure 1200 for example. The inner tube houses a spring 1406 which is retained at its upper end in the inner tube 1404 by a retaining pin 1408. A slot 1410 in the inner tube 1404 receives a pin 1412 that is connected to the outer tube 1402 and positioned below a lower end of the spring 1406. Thus, as the outer tube 1402 moves upward in response to a force and/or load imposed on a portion of the basketball system, such as the backboard assembly 1000, the pin 1412, which is connected to the outer tube 1402, moves upward in the slot 1410 compressing the spring 1406, and thereby allow movement or flex of the connecting structure 1200.

It should be noted that the shock absorbing element 1400 may be employed in any other embodiment disclosed herein. For example, shock absorbing element 1400 may be employed in addition to, or in place of, shock absorbing element 700 and/or 1300. As well, two or more of the various configurations of shock absorbing elements disclosed herein may be employed in a single basketball system. More generally, the shock absorbing elements disclosed herein, including the one addressed in the following discussion, should be considered to be interchangeable with each other.

Figure 11:
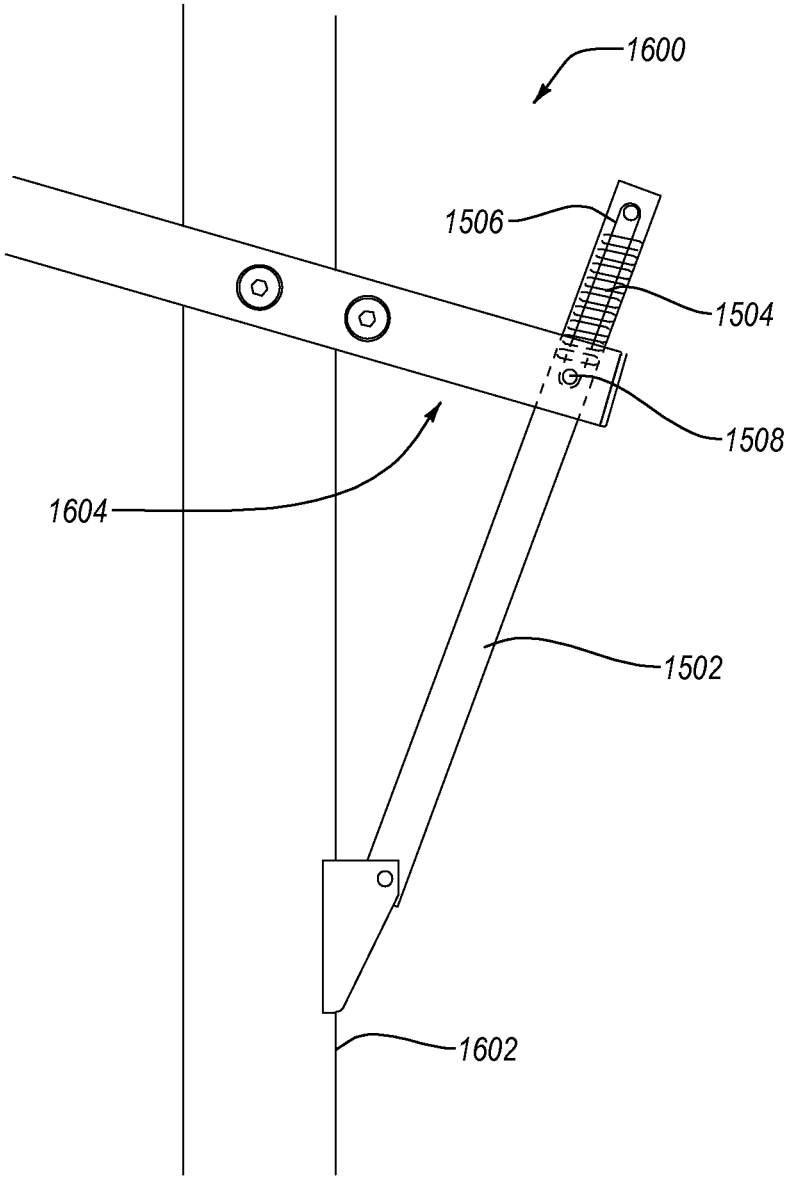
FIG. 11 is a partial side view of an example basketball system with a fixed height backboard assembly.

With attention next to FIG. 11, details are provided concerning an example of a shock absorbing element, denoted generally at 1500. As the connecting structure and support structure to which the shock absorbing element 1500 is indicated as being connected with are similar, if not identical, to connecting structure and support structure disclosed elsewhere herein, the following discussion focuses primarily on the shock absorbing element 1500.

As indicated in FIG. 11, the shock absorbing element 1500 may include a tube 1502 that is rotatably connected, directly indirectly, to a portion of a basketball system 1600, such as a support structure 1602 for example. The tube 1502 may house a spring 1504 or other resilient element. A slot 1506 defined in the tube 1502 slidingly receives a pin 1508 that is positioned below the spring 1504, and connected to a connecting structure 1604. Thus positioned and connected, the pin 1508 is able to move in unison with a portion of the connecting structure 1604. More specifically, the pin 1508 is moved upward in response to a force and/or load imposed on a portion of the basketball system, such as the backboard assembly (not shown), that causes an upward movement of the connecting structure 1604 to which the pin 1508 is connected. The flex or temporary movement of the connecting structure 1604 occurs as the pin 1508 moves upward in the slot 1506, thereby compressing the spring 1504, and allowing movement of a portion of the connecting structure 1200 in response to imposition of a load and/or force on the backboard assembly.

Figure 12:
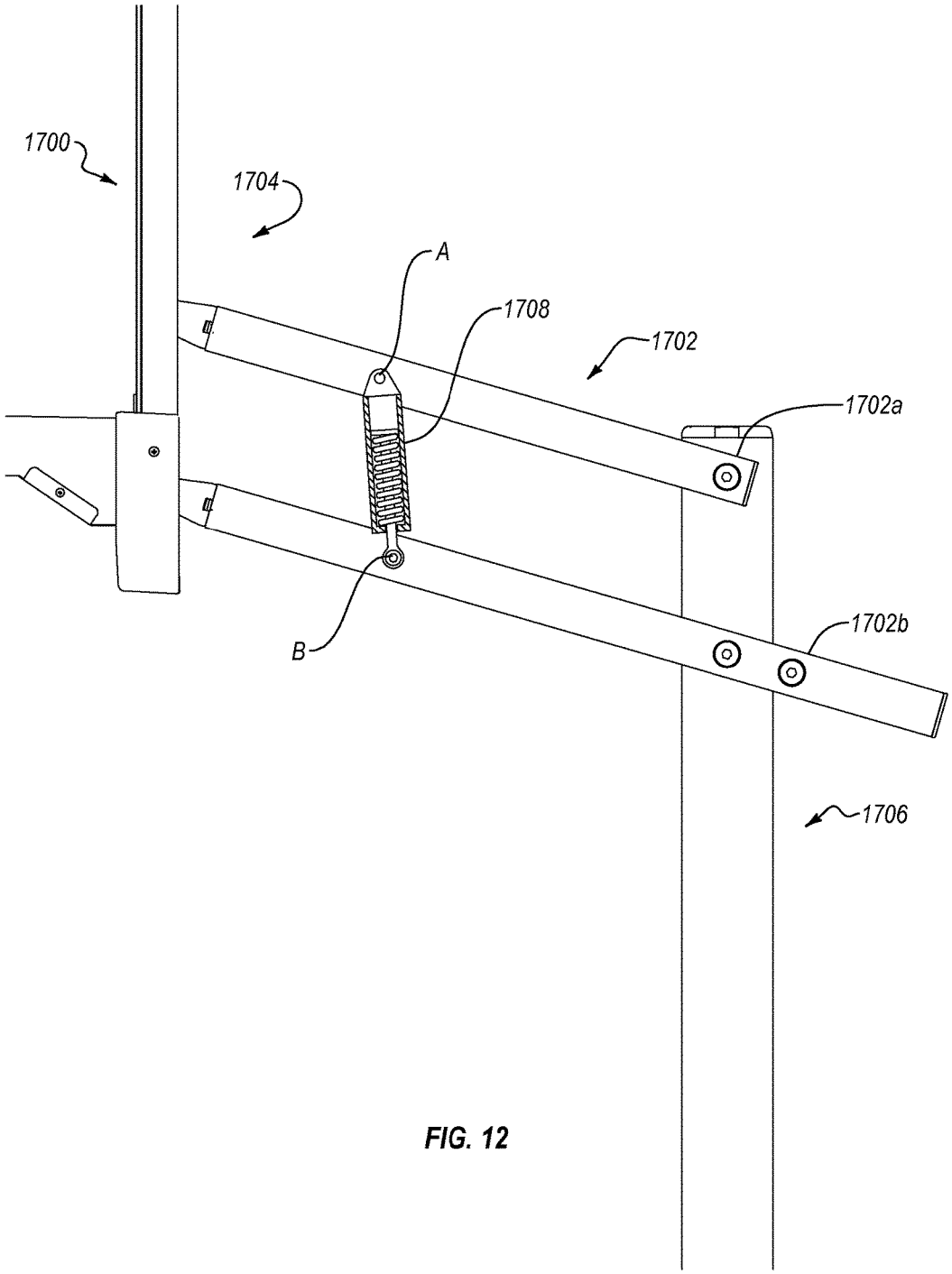
FIG. 12 is a partial side view of an example basketball system that may be configured with either an adjustable height backboard assembly, or a fixed height backboard assembly.

With attention now to FIG. 12, details are provided concerning an example of a basketball system 1700 that, like the other basketball systems disclosed herein, may employ any one of, or a combination of, the shock absorbing elements disclosed herein. In some implementations, the basketball system 1700 may include a height adjustment mechanism (not shown) while, in other implementations, the basketball system 1700 does not employ a height adjustment mechanism. Thus, the arrangement indicated in FIG. 12 can be employed in a variety of basketball systems without regard to whether or not the basketball system includes a height adjustment mechanism.

In the embodiment of FIG. 12, the basketball system 1700 may include a connecting structure 1702 that connects a backboard assembly 1704 to a support structure 1706. The connecting structure 1702 may be pivotally connected, either directly or indirectly, to the backboard assembly 1704 and the support structure 1706 so as to enable movement of the backboard assembly 1704. In the illustrated embodiment, the connecting structure 1702 may comprise first 1702*a* and second 1702*b* pairs of connecting members that may collectively define a parallelogram configuration where the two pairs 1702*a* and 1702*b* are able to move in unison with each other in at least some circumstances. In the example of FIG. 12, the connecting members 1702*b* may be relatively longer than the connecting members 1702*a*, but that is not necessary. In some embodiments the connecting members 1702*a* and 1702*b* may be substantially the same length.

As further indicated in FIG. 12, one or more shock absorbing elements 1708 may be provided that are connected to various elements of the basketball system 1700, such as the connecting members 1702*a* and 1702*b* for example. In one example, the shock absorbing element is connected to a connecting member 1702*a* and a connecting member 1702*b* by pins, bolts, rivets or any other suitable connector(s) at locations 'A' and 'B.' The connection of the shock absorbing element 1708 to the connecting members 1702*a* and 1702*b* may be such as to allow movement of the shock absorbing element 1708 in certain circumstances.

During use, if a force and/or load, such as a downward force and/or load, is exerted on a portion of the basketball system 1700, such as the backboard assembly 1704 for example, that exceeds a threshold force and/or load, respectively, locations 'A' and 'B' will move relative to each other. This movement is due to the parallelogram configuration of supporting members 1702*a* and 1702*b*, and to the pivotal connection of the supporting members 1702*a* and 1702*b* to the backboard assembly 1704 and support structure 1706. The shock absorbing element 1708 is configured so as to permit locations 'A' and 'B' to move closer together in response to a force and/or load greater than a threshold force and/or load, respectively. Thus configured and arranged, the shock absorbing element 1708 may substantially preserve the rigidity of a basketball system such as basketball system 1700 unless or until a force and/or load of a particular magnitude is imposed on the basketball system, at which time the shock absorbing element 1708 will permit the basketball system to flex, that is, the shock absorbing element 1708 will allow various elements of the basketball system 1700 to move relative to each other in response to imposition of that force and/or load.

As well, the angle of the shock absorbing element 1708 relative to connecting members 1702*a* and 1702*b* may be selected as desired to implement a desired shock absorbing effect. In some instances, the connecting members 1702*a* and/or 1702*b* may include a slot or track in which an end or connector of the shock absorbing element 1708 can be moved. Among other things, this configuration may allow a user to tune the basketball system to achieve a desired response when a load and/or force of a particular magnitude is imposed on the basketball system. Additionally or alternatively, multiple shock absorbing elements 1708 may be connected to connecting members 1702*a* and 1702*b*. The shock absorbing elements 1708 may or may not have substantially the same response to imposition of a particular load and/or force.

It should be noted that the configuration disclosed in FIG. 12 is provided only by way of example, and various other configurations and arrangements of a basketball system and shock absorbing element(s) may be implemented that are able to operate and respond to loads and forces as described above.

Moreover, as evidenced by this disclosure, shock absorbing elements such as those disclosed herein may, in general, be connected to movable and/or static elements of a basketball system. The following examples are illustrative. In FIGS. 9-11, a shock absorbing element is connected to a static element, namely, the support structure, and to a movable element, namely, a portion of the connecting structure. Such static elements may also be referred to herein as being elements that are substantially non-responsive to imposition of a force and/or load on the basketball system. In the example of FIG. 12, a shock absorbing element is connected only to movable elements, namely, elements of the connecting structure.

Figure 13:
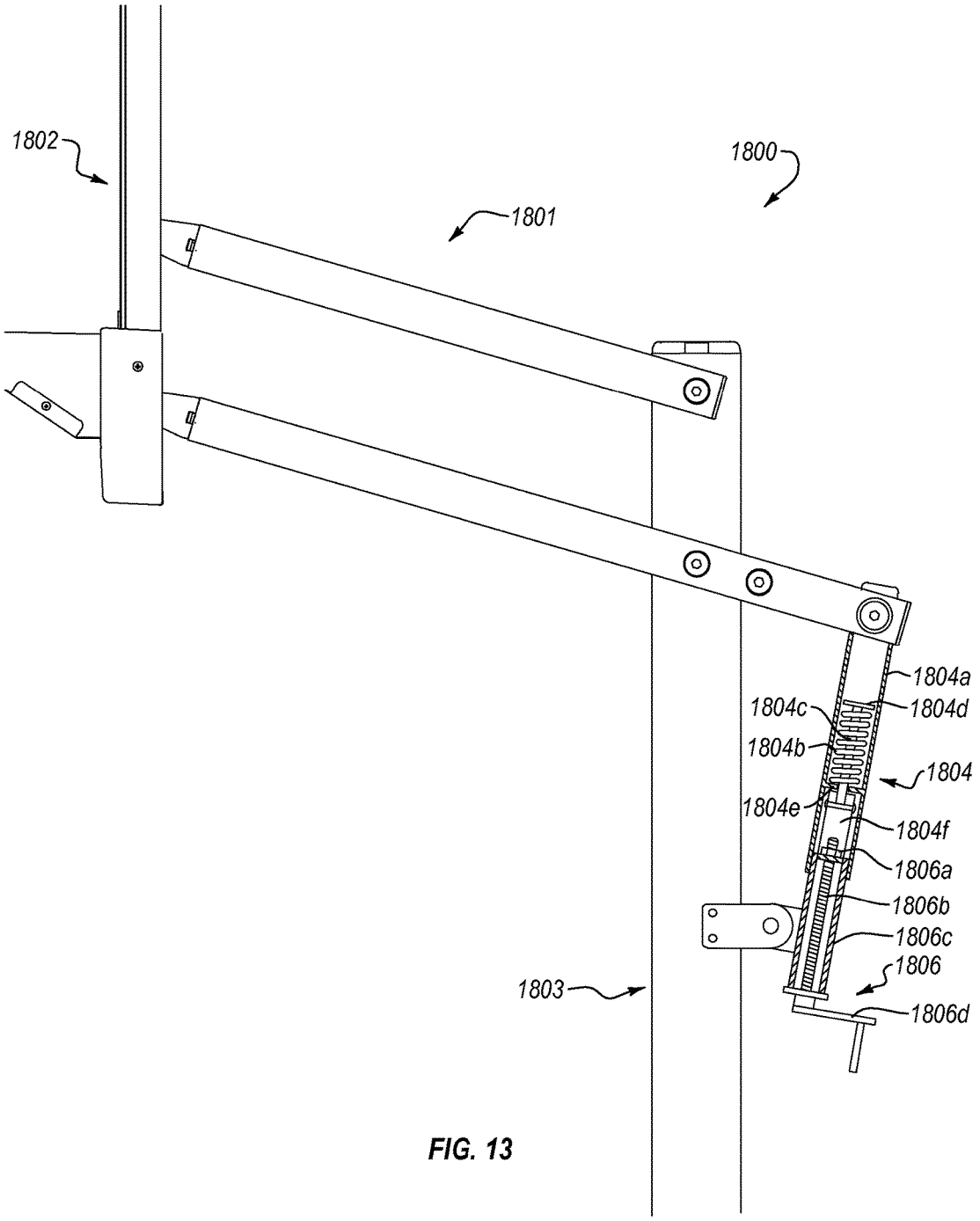
FIG. 13 is a partial side view of an example basketball system with an adjustable height backboard assembly.

Directing attention finally to FIG. 13, a basketball system 1800 is disclosed that includes a connecting structure 1801 that may be similar, if not identical, to connecting structure 1702 disclosed in FIG. 12. The connecting structure 1801 may connect a backboard assembly 1802 to a support structure 1803. In contrast with the arrangement of FIG. 12 however, the example embodiment of FIG. 13 includes a shock absorbing element 1804 that is connected to the connecting structure 1801 and arranged in-line with a height adjustment mechanism 1806. The shock absorbing mechanism may be a gas spring or, as in the example of FIG. 13, may include a resilient element such as a spring.

In FIG. 13, the height adjustment mechanism takes the form of a crank mechanism. It should be understood that the illustrated crank mechanism is presented only by way of example, and any other crank mechanism of similar structure and/or functionality may alternatively be employed.

With more particular attention to the various components of the example embodiment of FIG. 13, the shock absorbing element 1804 may include an outer housing 1804*a* within which is housed a resilient element 1804*b*, such as a die spring for example. Additionally, an inner rod 1804*c* is provided that includes a plate 1804*d* at its upper end. The inner rod 1804*c* is movable within the outer housing 1804*a* and passes through the resilient element 1804*b* and extends through a compression plate 1804*e* situated at or near the bottom of the outer housing 1804*a*. The compression plate 1804*e* and the plate 1804*d* cooperate to confine the resilient element 1804*b* within the outer housing 1804*a*.

The portion of the inner rod 1804*c* extending through the compression plate 1804*e* is connected to an inner housing 1804*f* that is at least partly received within, and movable relative to, the portion of the outer housing 1804*a* below the compression plate 1804*e*. A lower end of the inner housing 1804*f* includes a bearing nut 1806*a* configured to engage corresponding threads, which may be square threads, of a screw 1806*b*. In this way, the screw 1806*b* is connected to, and movable relative to, the inner housing 1804*f*. A portion of the inner housing 1804*f* may be received in, and movable relative to, a crank shaft tube 1806*c*. A crank 1806*d* is connected to the screw 1806*b*.

In operation, a user may adjust a height of the backboard assembly 1802 by rotating the crank 1806*d* in one direction or the other. As the user operates the height adjustment mechanism 1806 to raise the backboard assembly 1802, the inner housing 1804*f* to which the bearing nut 1806*a* is connected moves downward, pulling the inner rod 1804*c* that is connected to the inner housing 1804*f*. Consequently, the plate 1804*d* on the upper end of the inner rod 1804*c* pushes downward on the resilient element 1804*b* so as to pull the outer housing 1804*a*, within which the resilient element 1804*b* is confined, downward as well. The downward movement of the outer housing 1804*a*, which is connected to the connecting structure 1801, causes a corresponding upward movement of the backboard assembly 1802 that is connected to the connecting structure 1801. To lower the backboard assembly 1802, the user simply turns the crank in the direction opposite that which was used to raise the backboard assembly 1802.

It should be noted that because the resilient element 1804*b* may be relatively stiff, the resilient element 1804*b* is not substantially compressed when a user operates the height adjustment mechanism 1806. However, the resilient element 1804*b* is sufficiently compressible to provide a shock absorbing function if a force and/or load exceeding a threshold force and/or load, respectively, is imposed on the backboard assembly 1802.

Thus, if a force and/or load exceeding a threshold force and/or load, respectively, is imposed on the backboard assembly 1802 and/or goal (not shown), the outer housing 1804*a* to which the backboard assembly 1802 is ultimately connected moves upward so that the compression plate 1804*e* compresses the resilient element 1804*b* against the plate 1804*d*. In this way, the shock absorbing element 1804 enables temporary displacement of a portion of the backboard assembly 1802 and/or goal.

Although this disclosure has been described in terms of certain example embodiments, other embodiments apparent to those of ordinary skill in the art are also within the scope of this disclosure.

What is claimed is:

1. A basketball system, comprising:

a goal;

a backboard assembly to which the goal is connected, wherein a position of the goal relative to the backboard assembly is fixed;

a support structure;

a connecting structure that comprises three sets of arms, each set of arms being rotatably connected to the backboard assembly and to the support structure;

a height adjustment mechanism including a handle assembly that is directly connected to the support structure, the handle assembly being operable to change a height of the goal and backboard assembly;

a shock absorbing element having a first portion directly connected to the handle assembly, and the shock absorbing element having a second portion directly connected to the support structure of the basketball system, wherein the shock absorbing element enables temporary displacement of the goal and the backboard in response to imposition of a load or force on the goal, wherein the shock absorbing element comprises one or more of a spring, a gas spring, or a shock; and a structure directly connected to the handle assembly and directly connected to the connecting structure.

2. The basketball system as recited in claim 1, wherein the structure that is directly connected to the handle assembly and directly connected to the connecting structure comprises a shock absorbing element.

3. The basketball system as recited in claim 1, wherein the shock absorbing mechanism is arranged in parallel with the structure.

4. The basketball system as recited in claim 1, wherein an upward motion of the handle assembly causes a corresponding downward motion of the goal and backboard, and a downward motion of the handle assembly causes a corresponding upward motion of the goal and backboard.

5. The basketball system as recited in claim 1, wherein a height of the goal relative to a playing surface remains substantially unchanged in response to imposition of a first force and/or load on the goal, and the height of the goal relative to the playing surface changes in response to imposition of a second force and/or load on the goal, wherein the second force and/or load is greater than the first force and/or load.

6. The basketball system as recited in claim 5, wherein subsequent to removal of the second force or load, the shock absorbing element automatically returns the goal to the position that the goal was in prior to imposition of the second load or force.

7. The basketball system as recited in claim 1, wherein the handle assembly has a trigger-less configuration that enables a height of the goal to be adjusted without first requiring operation of a trigger.

8. A basketball system, comprising:

a goal;

a backboard assembly to which the goal is connected, wherein a position of the goal relative to the backboard assembly is fixed;

a support structure;

a connecting structure that comprises three sets of arms, each set of arms being rotatably connected to the backboard assembly and to the support structure;

a height adjustment mechanism including a handle assembly that is directly connected to the support structure, the handle assembly being operable to change a height of the goal and backboard assembly;

a shock absorbing element having a first portion directly connected to the handle assembly, and the shock absorbing element having a second portion directly connected to the connecting structure of the basketball system, wherein the shock absorbing element enables temporary displacement of the goal and the backboard in response to imposition of a load or force on the goal; and a structure directly connected to the handle assembly and directly connected to the support structure.

9. The basketball system as recited in claim 8, wherein the structure that is directly connected to the handle assembly and directly connected to the support structure comprises a gas spring.

10. The basketball system as recited in claim 8, wherein the shock absorbing element comprises a gas spring having a first portion connected directly to the handle assembly basketball system, and the gas spring having a second portion connected directly to the connecting structure.

11. The basketball system as recited in claim 8, wherein an upward motion of the handle assembly causes a corresponding downward motion of the goal and backboard, and a downward motion of the handle assembly causes a corresponding upward motion of the goal and backboard.

12. The basketball system as recited in claim 8, wherein a height of the goal relative to a playing surface remains substantially unchanged in response to imposition of a first force and/or load on the goal, and the height of the goal relative to the playing surface changes in response to imposition of a second force and/or load on the goal, wherein the second force and/or load is greater than the first force and/or load.

13. The basketball system as recited in claim 12, wherein subsequent to removal of the second force or load, the shock absorbing element automatically returns the goal to the position that the goal was in prior to imposition of the second load or force.

14. A basketball system, comprising:

a goal;

a backboard assembly to which the goal is connected, wherein a position of the goal relative to the backboard assembly is fixed;

a support structure;

a connecting structure that comprises three sets of arms, each set of arms being rotatably connected to the backboard assembly and to the support structure; and a height adjustment mechanism operable to change a height of the goal and backboard assembly, and the height adjustment mechanism including a shock absorbing element that enables temporary displacement of the goal and the backboard in response to imposition of a load or force on the goal, and the shock absorbing element automatically returns the goal and the backboard to their initial position after removal of the load or force, wherein the shock absorbing element has a first portion directly connected to an element of the height adjustment mechanism, and the shock absorbing element has a second portion directly connected to the support structure of the basketball system, and wherein the shock absorbing element comprises any one or more of a gas spring, a shock, and a spring.

* * * * *